US010305181B2

(12) United States Patent
Hong et al.

(10) Patent No.: US 10,305,181 B2
(45) Date of Patent: May 28, 2019

(54) ANTENNA, USER TERMINAL APPARATUS, AND METHOD OF CONTROLLING ANTENNA

(71) Applicant: Samsung Electronics Co., Ltd., Suwon-si, Gyeonggi-do (KR)

(72) Inventors: Won-bin Hong, Seoul (KR); Kwang-hyun Baek, Anseong-si (KR); Young-ju Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 635 days.

(21) Appl. No.: 14/220,738

(22) Filed: Mar. 20, 2014

(65) Prior Publication Data

US 2014/0285378 A1 Sep. 25, 2014

(30) Foreign Application Priority Data

Mar. 20, 2013 (KR) ..... 10-2013-0029970
Jul. 17, 2013 (KR) ..... 10-2013-0084316
Mar. 13, 2014 (KR) ..... 10-2014-0029867

(51) Int. Cl.
*H01Q 3/34* (2006.01)
*H01Q 3/00* (2006.01)
(Continued)

(52) U.S. Cl.
CPC ..... *H01Q 3/34* (2013.01); *H01Q 1/243* (2013.01); *H01Q 1/38* (2013.01); *H01Q 3/00* (2013.01);
(Continued)

(58) Field of Classification Search
CPC .. H01Q 3/22; H01Q 3/24; H01Q 3/26; H01Q 3/30; H01Q 3/32; H01Q 3/34; H01Q 3/36; H01Q 5/40; H01Q 9/0407; H01Q 9/065
See application file for complete search history.

(56) References Cited

U.S. PATENT DOCUMENTS 4,780,724 A 10/1988 Sharma et al.
5,973,646 A * 10/1999 Engblom ..... H01Q 1/242 343/702
(Continued)

FOREIGN PATENT DOCUMENTS

CN 1538556 A 10/2004
CN 1890675 A 1/2007
(Continued)

OTHER PUBLICATIONS

Theodore S. Rappaport et al., State of the Art in 60-GHz Integrated Circuits and Systems for Wireless Communications, Proceedings of the IEEE, vol. 99, No. 8, Aug. 2011.
(Continued)

*Primary Examiner* — Vladimir Magloire
*Assistant Examiner* — Daniel P Malley, Sr.
(74) *Attorney, Agent, or Firm* — Jefferson IP Law, LLP

(57) ABSTRACT

An antenna is provided. The antenna includes a first radiator, a second radiator, a current feeder configured to supply power to at least one of the first radiator and the second radiator, and an adjuster configured to adjust transceiving directions of electromagnetic waves transmitted and received to and from the first radiator and the second radiator to be perpendicular to each other.

20 Claims, 29 Drawing Sheets

(51) Int. Cl.

| | |
|---|---|
| ***H01Q 21/29*** | (2006.01) |
| ***H01Q 1/24*** | (2006.01) |
| ***H01Q 1/38*** | (2006.01) |
| ***H01Q 3/24*** | (2006.01) |
| ***H01Q 3/26*** | (2006.01) |
| ***H01Q 9/04*** | (2006.01) |
| ***H01Q 21/06*** | (2006.01) |
| ***H01Q 25/00*** | (2006.01) |
| ***H01Q 9/14*** | (2006.01) |

(52) U.S. Cl.

CPC ..... *H01Q 3/24* (2013.01); *H01Q 3/26* (2013.01); *H01Q 9/0414* (2013.01); *H01Q 9/0442* (2013.01); *H01Q 9/14* (2013.01); *H01Q 21/06* (2013.01); *H01Q 21/29* (2013.01); *H01Q 25/00* (2013.01)

(56) References Cited

U.S. PATENT DOCUMENTS 6,295,462 B1 * 9/2001 Kudoh ..... H01Q 21/28 343/702
6,633,257 B2 10/2003 Ito
7,046,201 B2 * 5/2006 Okada ..... H01Q 1/22 343/700 MS
7,099,690 B2 8/2006 Milosavljevic
7,109,923 B2 9/2006 Ollikainen et al.
7,345,632 B2 3/2008 Smith et al.
7,444,734 B2 11/2008 Gaucher et al.
7,486,975 B2 * 2/2009 Mori ..... H01Q 21/29 343/700 R
7,683,788 B2 3/2010 Turner
7,830,312 B2 11/2010 Choudhury et al.
7,852,265 B2 12/2010 Milano et al.
8,022,887 B1 9/2011 Zarnaghi
8,125,393 B2 2/2012 Dreina et al.
8,502,745 B2 8/2013 Park et al.
2002/0106995 A1 * 8/2002 Callaway, Jr. ..... H01Q 1/241 455/101
2004/0207559 A1 10/2004 Milosavljevic
2005/0239519 A1 * 10/2005 Saitou ..... H01Q 1/243 455/575.1
2005/0264451 A1 * 12/2005 Aikawa ..... H01Q 21/065 343/700 MS
2006/0145921 A1 * 7/2006 Ranta ..... H01Q 1/007 342/374
2007/0109203 A1 5/2007 Park et al.
2007/0139276 A1 * 6/2007 Svigelj ..... H01Q 1/38 343/700 MS
2007/0252698 A1 11/2007 Turner
2008/0068271 A1 * 3/2008 Iwai ..... H01Q 1/245 343/702
2008/0088510 A1 * 4/2008 Murata ..... H01Q 3/24 343/700 MS
2008/0252534 A1 * 10/2008 Okayama ..... H01Q 1/243 343/702
2008/0272962 A1 11/2008 Milano
2009/0125746 A1 * 5/2009 Rofougaran ..... H01L 23/66 713/400
2010/0045557 A1 2/2010 Park et al.
2010/0188289 A1 * 7/2010 Milano ..... H01Q 1/246 342/368
2010/0237996 A1 9/2010 Turner
2011/0080325 A1 4/2011 Livneh et al.
2012/0081254 A1 * 4/2012 Moon ..... H01Q 3/24 343/720
2012/0098730 A1 4/2012 Kish et al.
2012/0105286 A1 * 5/2012 Rhyu ..... H01Q 1/243 343/702
2012/0182189 A1 * 7/2012 Wu ..... H01Q 1/243 343/702
2012/0329407 A1 * 12/2012 Rousu ..... H01Q 3/2605 455/90.2
2013/0009729 A1 1/2013 Kim
2013/0023210 A1 * 1/2013 Rofougaran ..... H01L 23/66 455/41.1
2014/0162734 A1 * 6/2014 Shewan ..... H01Q 9/0421 455/575.7

FOREIGN PATENT DOCUMENTS

| | | | |
|---|---|---|---|
| EP | 1 289 049 | A1 | 3/2003 |
| JP | 2000-236209 | A | 8/2000 |
| JP | 2001-326328 | A | 11/2001 |
| JP | 2005-269199 | A | 9/2005 |
| JP | 2009-033571 | A | 2/2009 |
| JP | 2009-055245 | A | 3/2009 |
| JP | 2010-530652 | A | 9/2010 |
| JP | 4877155 | B2 | 2/2012 |
| KR | 20-1991-005007 | U | 3/1991 |
| KR | 10-2010-0022374 | A | 3/2010 |
| KR | 10-2011-0077594 | A | 7/2011 |
| KR | 10-1207676 | B1 | 12/2012 |

OTHER PUBLICATIONS

Arnaud L. Amadjikpe et al., Highly Directive Package-Integrated Dipole Arrays for Low-Cost 60-GHz Front End Modules, 2010 IEEE.
Helen K. Pan et al., Array Analysis using High Efficiency Mm-wave Antenna for Gigabit Plus Throughput Wireless Communication, 2009 IEEE.
Arnaud L. Amadjikpe et al., High Gain Quasi-Yagi Planar Antenna Evaluation in Platform Material Environment for 60 GHz Wireless Applications, 2009 IEEE.
Yuanxin Li et al: "A Fixed-Frequency Beam-Scanning Microstrip Leaky Wave Antenna Array", IEEE Antennas and Wireless Propagation Letters, IEEE, Piscataway, NJ, US, vol. 6, Dec. 1, 2007 (Dec. 1, 2007).
Yi-Lin Chiou et al: "Design of Short Microstrip Leaky-Wave Antenna With Suppressed Back Lobe and Increased Frequency Scanning Region", IEEE Transactions on Antennas and Propagation, IEEE Service Center, Piscataway, NJ, US, vol. 57, No. 10, Oct. 1, 2009 (Oct. 1, 2009).
Hui Li et al: "A compact reconfigurable antenna with pattern diversity", Antennas and Propagation Society International Symposium (APSURSI), 2012 IEEE, IEEE, Jul. 8, 2012 (Jul. 8, 2012).
JPL; Maximum Ratio Combining Diversity; JPL's Wireless Communication Reference Website; Analog and Digital Transmission; Diversity; XP055309214; Jan. 1, 1995.
Ghasemi et al.; A Reconfigurable Printed Monopole Antenna for MIMO Application; XP055381901; EuCAP 2012; Mar. 26, 2012.
Kornek et al., Reconfigurable Triangular Patch Antenna for Pattern Diversity, 3rd European Conference on Antennas and Propagation. EUCAP 2009, Mar. 23-27, 2009—Berlin, Germany, IEEE, Piscataway, NJ, USA, Mar. 23, 2009 (Mar. 23, 2009), pp. 3744-3747, XP031470578.
Chinese Office Action dated Apr. 24, 2018 issued in Chinese Patent Application No. 201480017221.8.
European Office Action dated Feb. 19, 2018 issued in European Patent Application No. 14 771 056.0-1205.
Japanese Patent Office Action dated Aug. 8, 2018, issued in Japanese Application No. 2016-504253.

* cited by examiner

ANTENNA, USER TERMINAL APPARATUS, AND METHOD OF CONTROLLING ANTENNA

CROSS-REFERENCE TO RELATED APPLICATION(S)

This application claims the benefit under 35 U.S.C. § 119(a) of a Korean patent application filed on Mar. 20, 2013 in the Korean Intellectual Property Office and assigned Serial number 10-2013-0029970, and of a Korean patent application filed on Jul. 17, 2013 in the Korean Intellectual Property Office and assigned Serial number 10-2013-0084316, and of a Korean patent application filed on Mar. 13, 2014 in the Korean Intellectual Property Office and assigned Serial number 10-2014-0029867, the entire disclosure of each of which is hereby incorporated by reference.

TECHNICAL FIELD

The present disclosure relates to an antenna, a user terminal apparatus, and a method of controlling an antenna. More particularly, the present disclosure relates to an antenna, a user terminal apparatus, and a method of controlling an antenna, which performs both vertical radiation and horizontal radiation of electromagnetic wave.

BACKGROUND

An antenna is a component that converts an electrical signal into a predetermined electromagnetic wave and radiates the electromagnetic wave or performs an opposite operation. In general, the form of a valid region radiated or detected by an antenna is referred to as a radiation pattern.

FIG. 1 is a diagram for explanation of a vertical radiation antenna according to the related art.

FIG. 1 illustrates a lap-top computer 10 including a vertical radiation antenna 11. In this case, an apparatus including the vertical radiation antenna 11 may be a Tele-Vision (TV), a cellular phone, a wireless hub, etc. as well as the lap-top computer 10. The vertical radiation antenna 11 may transmit a signal of the lap-top computer 10 to the outside or allow the lap-top computer 10 to receive an external signal.

The vertical radiation antenna 11 may be formed as one or more chips. In this regard, as illustrated in FIG. 1, a radiation pattern of the vertical radiation antenna 11 may be formed in a perpendicular direction to upper and lower surfaces of the chip. In this sense, the vertical radiation antenna 11 may be referred to as a broadcast antenna. In addition, the radiation pattern may be tilted according to design of the vertical radiation antenna 11. However, the radiation pattern of the vertical radiation antenna 11 is formed in the perpendicular direction, and even if a tilt of the radiation pattern is formed, the tilt may not generally exceed a maximum of 60 degrees. Accordingly, when the vertical radiation antenna 11 is used, problems arise in that a radiation pattern in a horizontal direction cannot be formed.

FIG. 2 is a diagram for explanation of a horizontal radiation antenna according to the related art.

FIG. 2 illustrates a smart phone 20 including the horizontal radiation antenna 21. In this case, an apparatus including the horizontal radiation antenna 21 may be a tablet Personal Computer (PC) as well as the smart phone 20 and may be used in a chip-to-chip interface, or the like. The horizontal radiation antenna 21 may transmit a signal of the smart phone 20 to the outside and/or allow the smart phone 20 to receive an external signal.

As illustrated in FIG. 2, when the horizontal radiation antenna 21 is formed in a y-axis direction, a radiation pattern of the horizontal radiation antenna 21 may be formed in the y-axis direction. In this sense, the horizontal radiation antenna 21 may also be referred to as an end-fire antenna. That is, the radiation pattern of the horizontal radiation antenna 21 is formed in a horizontal direction with respect to the horizontal radiation antenna 21. Thus, when the horizontal radiation antenna 21 is used, problems arise in that a radiation pattern in a vertical direction cannot be formed.

In order to overcome the aforementioned problem, the vertical radiation antenna 11 and the horizontal radiation antenna 21 are embodied with a Three-Dimensional (3D) shape in a single antenna to allow vertical radiation and horizontal radiation. However, in this case, the size of the antenna is significantly increased, and thus, problems arise in that it is difficult to install the antenna and it is complex to embody radiation patterns.

Accordingly, an antenna, a user terminal apparatus, and a method of controlling an antenna, which performs both vertical radiation and horizontal radiation of electromagnetic wave is desired.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below.

The present disclosure provides an antenna, a user terminal apparatus, and a method of controlling an antenna, which performs both vertical radiation and horizontal radiation of electromagnetic wave.

In accordance with an aspect of the present disclosure, an antenna is provided. The antenna includes a first radiator, a second radiator, a current feeder configured to supply power to at least one of the first radiator and the second radiator, and an adjuster configured to adjust transceiving directions of electromagnetic waves transmitted and received to and from the first radiator and the second radiator to be perpendicular to each other.

In accordance with an aspect of the present disclosure, a wireless communication apparatus is provided. The wireless communication apparatus includes an antenna including a first radiator, a second radiator, a current feeder configured to supply power to at least one of the first radiator and the second radiator, and an adjuster configured to adjust transceiving directions of electromagnetic waves transmitted and received to and from the first radiator and the second radiator to be perpendicular to each other, and a controller configured to control an operation of the antenna in order to perform wireless communication.

In accordance with an aspect of the present disclosure, a wireless communication method is provided. The wireless communication method includes supplying power to at least one of a first radiator and a second radiator, and adjusting transceiving directions of electromagnetic waves transmitted and received to and from the first radiator and the second radiator to be perpendicular to each other, and transmitting and receiving the electromagnetic waves.

In accordance with an aspect of the present disclosure, a wireless communication method is provided. The wireless communication method includes supplying power to at least one of a first radiator and a second radiator, and adjusting transceiving directions of electromagnetic waves transmitted and received to and from the first radiator and the second radiator to be perpendicular to each other, and transmitting and receiving the electromagnetic wave.

Additional and/or other aspects and advantages of the invention will be set forth in part in the description which follows and, in part, will be obvious from the description, or may be learned by practice of the invention.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
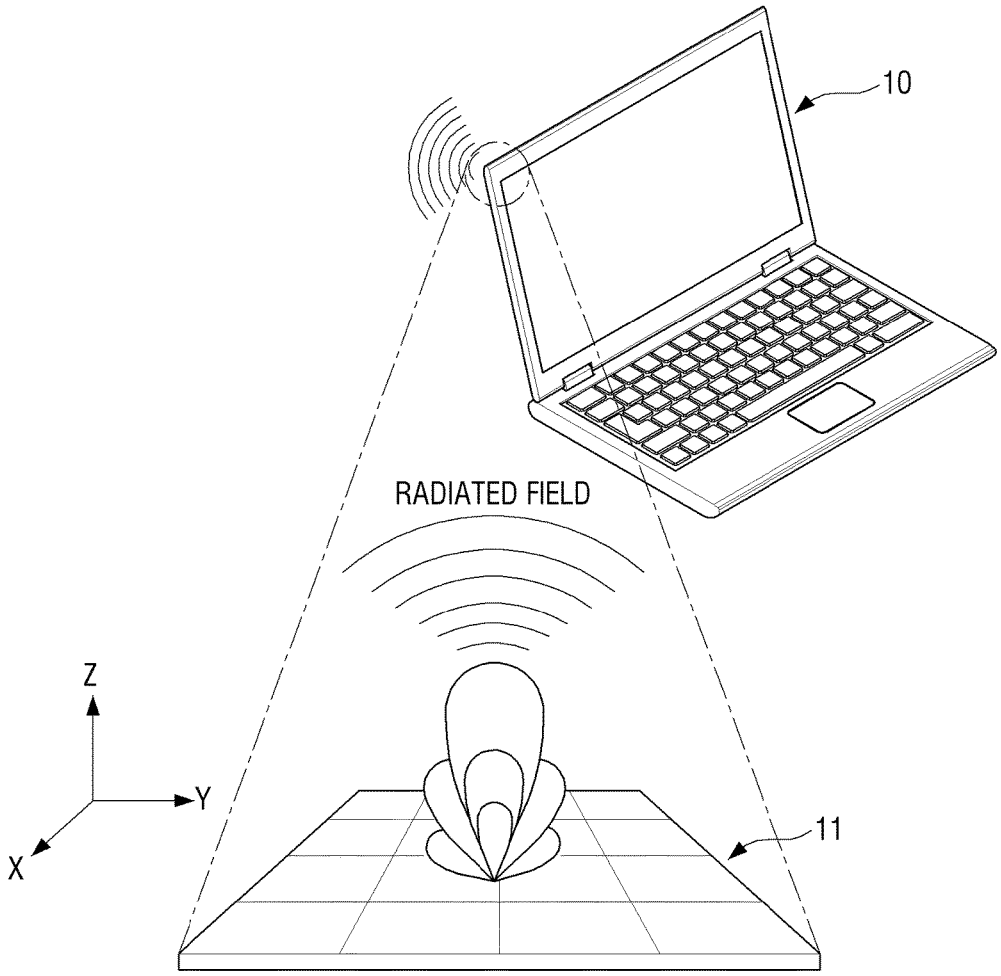
FIG. 1 (RELATED ART)
FIG. 1 is a diagram for explanation of a conventional vertical radiation antenna according to the related art.
Figure 2:
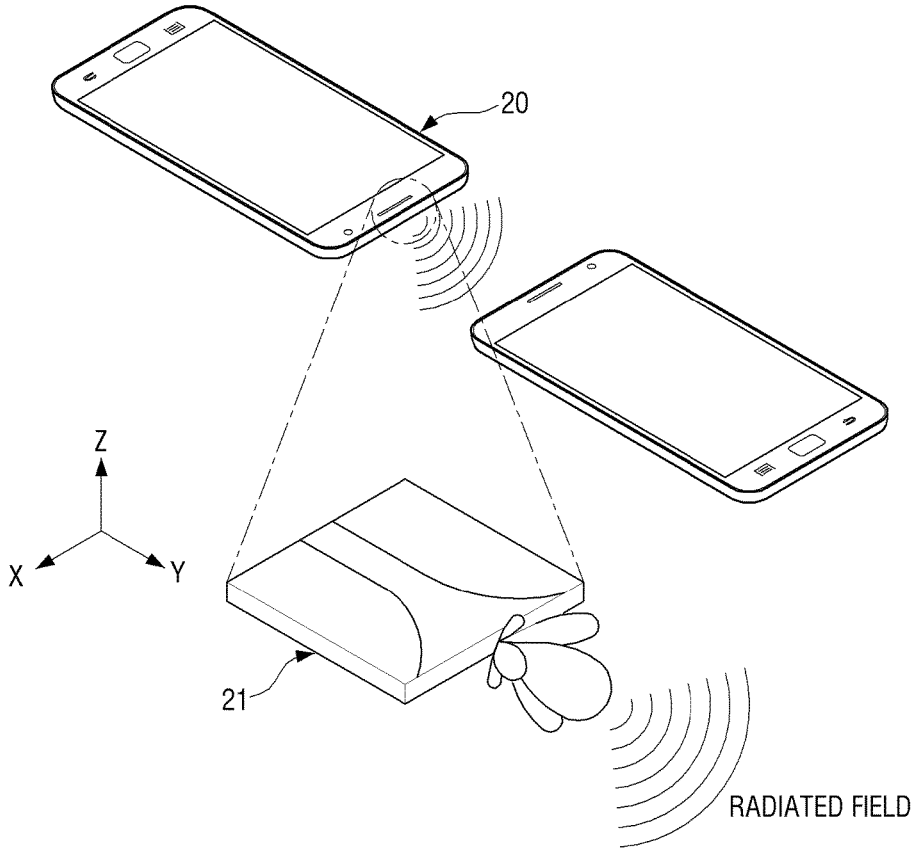
FIG. 2 (RELATED ART)
FIG. 2 is a diagram for explanation of a conventional horizontal radiation antenna according to the related art.
Figure 2A:
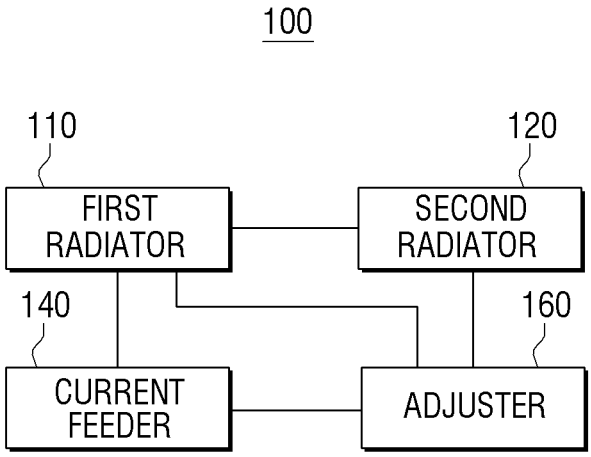
Figure 3A:
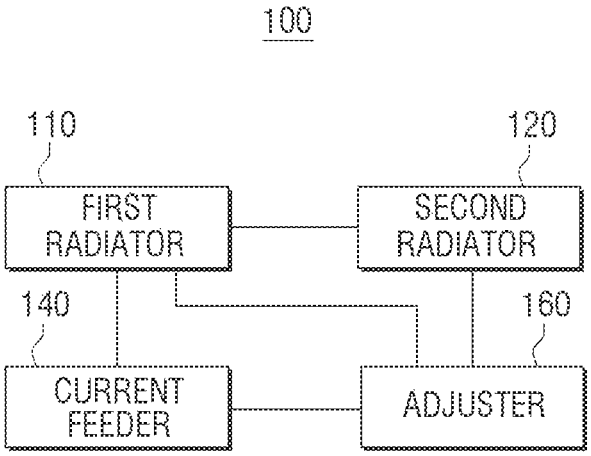
FIG. 3A is a block diagram of an antenna according to an embodiment of the present disclosure.

FIG. 3A is a block diagram of an antenna according to an embodiment of the present disclosure.

Referring to FIG. 3A, an antenna 100 according to an embodiment of the present disclosure includes a first radiator 110, a second radiator 120, a current feeder 140, and an adjuster 160.

The first radiator 110 is a component that receives electromagnetic energy from the current feeder 140 and radiates electromagnetic waves due to the received electromagnetic energy to the outside. In this case, the electromagnetic wave radiated to the outside by the first radiator 110 may be radiated in a first direction, but the radiation direction of the electromagnetic wave may be adjusted by the adjuster 160 that will be described below.

The second radiator 120 is a component that receives electromagnetic energy from the current feeder 140 through the first radiator 210 and radiates electromagnetic waves due to the received electromagnetic energy to the outside. In this case, the electromagnetic wave radiated to the outside by the second radiator 120 may be radiated in a second direction, but the radiation direction of the electromagnetic wave may be adjusted by the adjuster 160 that will be described below.

The current feeder 140 supplies power to at least one of the first radiator 110 and the second radiator 120. A radiator that receives electromagnetic energy from the current feeder 140 may radiate electromagnetic waves due to the received electromagnetic energy to the outside to transmit a desired signal to the outside.

The adjuster 160 may adjust the transceiving direction of the electromagnetic wave transmitted and received by the first radiator 110 and the second radiator 120 to a vertical direction. In addition, the adjuster 160 may adjust the transceiving direction of the electromagnetic wave transmitted and received by the first radiator 110 and the second radiator 120 to a horizontal direction. The adjuster 160 may separately adjust the electromagnetic wave transmitted and received by the first radiator 110 and the second radiator 120. As described below, the adjuster 160 may include a plurality of switches or a phase adjuster.

Figure 3B:
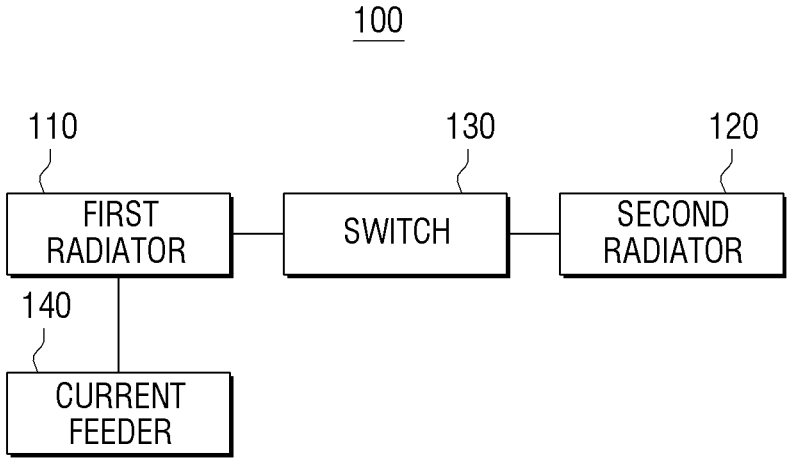
FIG. 3B is a block diagram of an antenna according to an embodiment of the present disclosure.

FIG. 3B is a block diagram of an antenna according to an embodiment of the present disclosure.

Referring to FIG. 3B, an antenna 100 according to an embodiment of the present disclosure includes a first radiator 110, a second radiator 120, a current feeder 140, and a switch 130.

The current feeder 140 may be connected to a radiator to feed electromagnetic energy to the radiator. The fed electromagnetic energy may be transmitted to the radiator. The radiator that receives the electromagnetic energy from the current feeder 140 may radiate electromagnetic wave due to the electromagnetic energy to the outside to transmit a desired signal to the outside. In this case, the current feeder 140 may be connected to the first radiator 110.

The first radiator 110 may receive electromagnetic energy from the current feeder 140 and radiate electromagnetic wave due to the received electromagnetic energy. In this case, the electromagnetic wave radiated to the outside by the first radiator 110 may be radiated in a first direction, and the first direction may be a perpendicular to a direction in which the first radiator 110 is formed.

The second radiator 120 may receive electromagnetic energy from the first radiator 110 that receives electromagnetic energy from the current feeder 140, and the second radiator 120 that receives electromagnetic energy from the first radiator 110 may radiate electromagnetic wave due to electromagnetic energy to the outside to transmit a desired signal. In this case, the electromagnetic wave radiated to the outside by the second radiator 120 may be radiated in a second direction, and the second direction may be perpendicular to a direction in which the second radiator 120 is formed.

The switch 130 is switched between the first radiator 110 and the second radiator 120. That is, the switch 130 may be disposed between the first radiator 110 and the second radiator 120 and may determine whether electromagnetic energy output from the current feeder 140 to the first radiator 110 or the second radiator 120 according to switching.

When the switch 130 is turned off, the first radiator 110 and the second radiator 120 are spaced apart from each other. In this case, the current feeder 140 is connected to the first radiator 110, and the switch 130 is turned off such that electromagnetic energy fed by the current feeder 140 is not transmitted to the second radiator 120. Thus, electromagnetic energy may be lastly transmitted to the first radiator 110, and electromagnetic wave may be radiated in a first direction perpendicular to a direction in which the first radiator 110 is formed.

When the switch 130 is turned on, the first radiator 110 and the second radiator 120 are connected to each other. In this case, the current feeder 140 is connected to the first radiator 110 and the switch 130 is turned on to transmit electromagnetic energy fed by the current feeder 140 to the second radiator 120. Accordingly, electromagnetic energy may be lastly transmitted to the second radiator 120, and electromagnetic wave may be radiated in a second direction perpendicular to a direction in which the second radiator 120 is formed.

Figure 4:
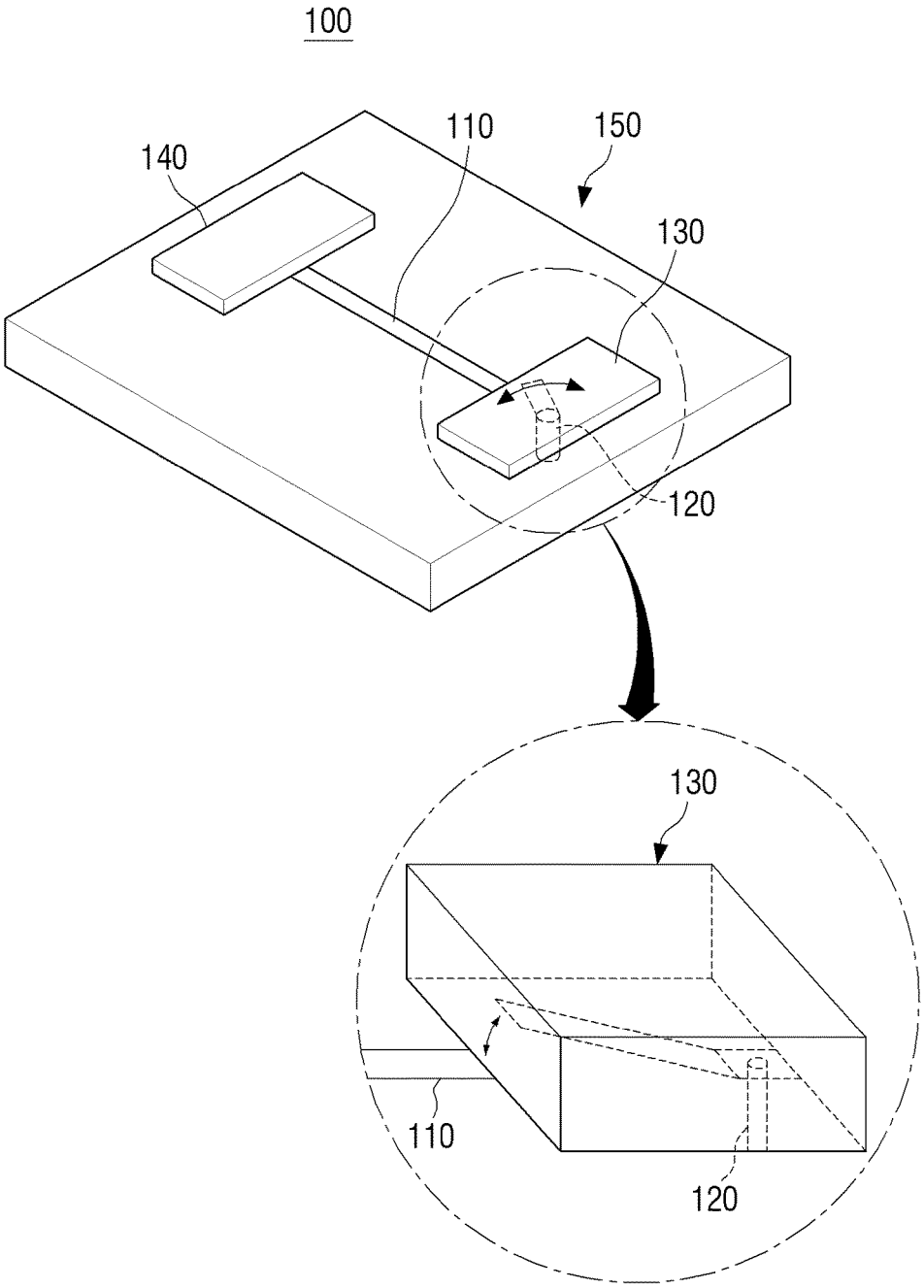
FIG. 4 is a perspective view of an antenna according to an embodiment of the present disclosure.

FIG. 4 is a perspective view of an antenna according to an embodiment of the present disclosure.

Referring to FIG. 4, an antenna 100 according to an embodiment of the present disclosure includes a first radiator 110, a second radiator 120, a switch 130, a current feeder 140, and a substrate 150. Hereinafter, a repeated description of the above description will be omitted.

The substrate 150 may support the first radiator 110 and the second radiator 120 to form the antenna 100. In this case, the substrate 150 may be a Printed Circuit Board (PCB), and patterns may be formed on an upper or lower surface of the substrate 150. That is, patterns for formation of the first radiator 110, the current feeder 140, and the switch 130 may be formed on the upper surface of the substrate 150, and a via hole for formation of the second radiator 120 may be formed at one side of the substrate 150.

The current feeder 140 and the switch 130 may be formed on the upper surface of the substrate 150, and in particular, may be components that are spaced apart from each other by a predetermined distance and are mounted on the upper surface of the substrate 150. Here, the switch 130 may include various components such as a PIN diode, a phase shifter, a MEMS switch, Single Pole Double Throw (SPDT), Single Pole Single Throw (SPST), Double Pole Single Throw (DPST), Double Pole Double Throw (DPDT), or the like.

The first radiator 110 may be formed on the upper surface of the substrate 150, and in particular, may be formed of an electroconductive material as a pattern on the upper surface of the substrate 150. In addition, one side of the first radiator 110 may be connected to an output terminal of the current feeder 140 in order to receive electromagnetic energy fed by the current feeder 140, and the other side of the first radiator 110 may be connected to the switch 130 so as to be connected to or spaced apart from the second radiator 120. In this case, the length of the first radiator 110 may correspond to a predetermined distance between the current feeder 140 and the switch 130.

A via hole (not illustrated) may be formed in one side of the substrate 150 and may not be formed through the substrate 150. The same electroconductive material as the first radiator 110 may be filled in the formed via hole. In this regard, the same electroconductive material as the first radiator 110 is filled in the via hole to form the second radiator 120. Thus, the second radiator 120 may be formed in a perpendicular direction to an arrangement direction of the first radiator 110 and in a perpendicular direction to opposite surfaces of the substrate 150. One side of the second radiator 120 is connected to the switch 130 and the first radiator 110 and the second radiator 120 are connected to or spaced apart from each other according to switching of the switch 130. Thus, when the switch 130 is turned on, the first radiator 110 and the second radiator 120 are connected to form one radiator, and when the switch 130 is turned off, the first radiator 110 spaced apart from the second radiator 120 forms one radiator.

Resonance refers to an effect in which a radiator most effectively receives and transmits electromagnetic wave with a specific wavelength, and a frequency at which resonance occurs is referred to as a resonance frequency. When a wavelength of a resonance frequency is $\lambda$, the length of a radiator according to an embodiment of the present disclosure may be set to $(1/4)\lambda$. Thus, the length of the first radiator 110 may be $(n/4)\lambda$, and the length of a radiator formed by connecting the first radiator 110 and the second radiator 120 may be $(m/4)\lambda$ (where n and m are each a natural number).

When an antenna according to an embodiment of the present disclosure is used, one antenna performs both a vertical radiation function and a horizontal radiation function. Even if one antenna performs the two functions, the antenna may be miniaturized. In addition, one radiator is disposed on a substrate and a radiator is disposed in a perpendicular direction to the radiator, and thus, the antenna performs both a vertical radiation function and a horizontal radiation function, thereby achieving the productivity of the antenna.

Figure 5:
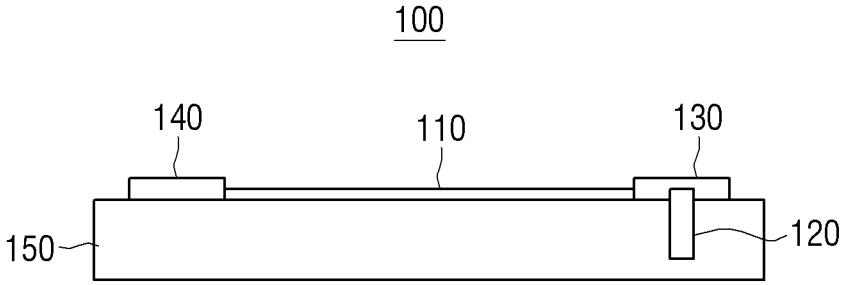
FIGS. 5 and 6 are cross-sectional views of an antenna according to an embodiment of the present disclosure.
Figure 6:
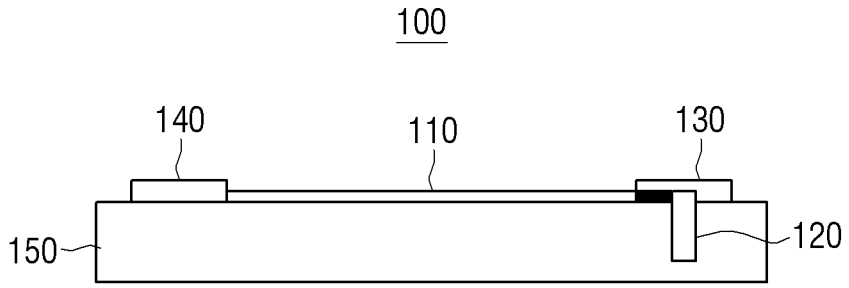

FIGS. 5 and 6 are cross-sectional views of an antenna according to an embodiment of the present disclosure. FIG. 5 is a cross-sectional view of a case in which a switch is turned off, and FIG. 6 is a cross-sectional view of a case in which the switch is turned on. Hereinafter, a repeated description of the above description will be omitted.

Referring to FIG. 5, a switch 130 is turned off such that a first radiator 110 and a second radiator 120 are spaced apart from each other, and thus, electromagnetic energy fed by a current feeder 140 is not transmitted to the second radiator 120, and is transmitted to the first radiator 110. In general, a radiator receiving electromagnetic energy may generate electromagnetic wave at an opposite end portion to a portion connected to the current feeder 140. Thus, when the switch 130 is turned off, electromagnetic wave may be generated at an opposite end portion to a portion of the first radiator 110, to which the current feeder 140 is connected. According to an embodiment of the present disclosure, the switch 130 may be turned off such that radiation of the first radiator 110 may be performed in a first direction. In this case, the first direction may be a vertical direction that is perpendicular to a direction in which the first radiator 110 is formed.

Referring to FIG. 6, the switch 130 is turned on such that the first radiator 110 and the second radiator 120 are connected to each other, and thus, electromagnetic energy fed by the current feeder 140 is transmitted to the second radiator 120 through the first radiator 110. Thus, when the switch 130 is turned on, an entire portion obtained by connecting the first radiator 110 and the second radiator 120 functions as one radiator. A radiator receiving electromagnetic energy may generate electromagnetic wave at an opposite end portion to a portion connected to the current feeder 140. Thus, electromagnetic wave may be generated at an opposite end portion to a portion of the second radiator 120, to which the current feeder 140 is connected. According to an embodiment of the present disclosure, when the switch 130 is turned on such that radiation of the second radiator 120 may be performed in a second direction. In this case, the second direction may be a horizontal direction that is perpendicular to a direction in which the second radiator 120 is formed.

Figure 7:
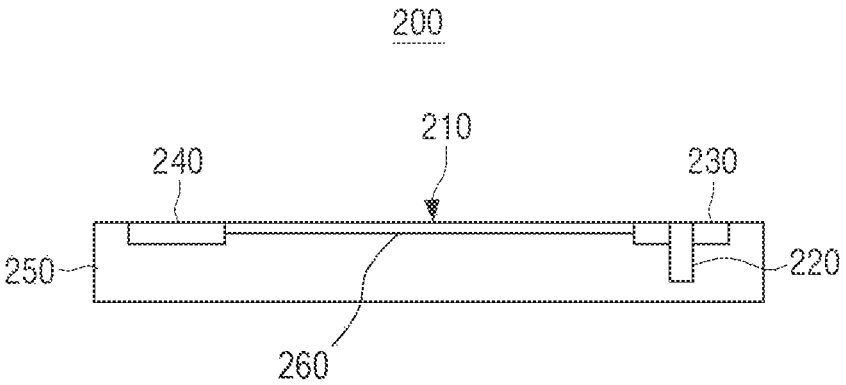
FIGS. 7 and 8 are cross-sectional views of an antenna according to an embodiment of the present disclosure.
Figure 8:
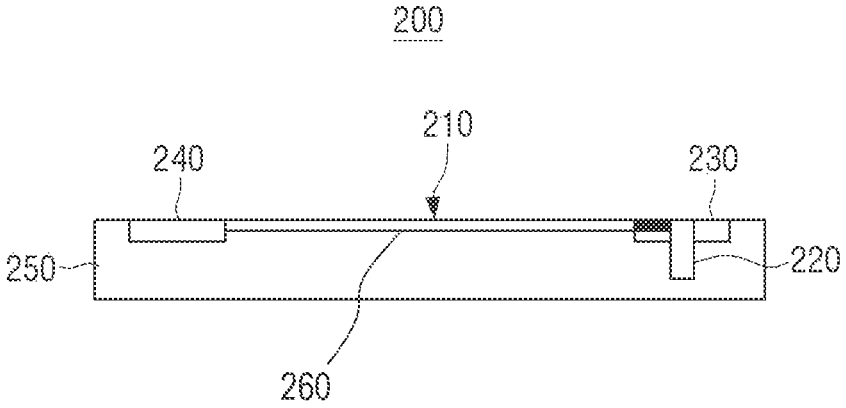

FIGS. 7 and 8 are cross-sectional views of an antenna according to an embodiment of the present disclosure. FIG. 7 is a cross-sectional view of a case in which a switch is turned off, and FIG. 8 is a cross-sectional view of a case in which the switch is turned on.

Referring to FIGS. 7 and 8, a current feeder 240, a switch 230, and a first radiator 210 may be disposed on regions formed by etching portions of an upper surface of a substrate 250, and in detail, the upper surface of the substrate 250 may be etched so as to form a current feeder 240, the switch 230, and the first radiator 210 at the same layer level. In particular, the first radiator 210 may be disposed in a groove 260 that is concavely formed in the upper surface of the substrate 250. That is, the thickness of the antenna 200 according to an embodiment of the present disclosure may be the same as the thickness of the antenna 200.

Accordingly, referring to FIG. 7, the switch 230 may be turned off such that radiation of the first radiator 210 may be performed in a first direction. In this case, the first direction may be a vertical direction that is perpendicular to a direction in which the first radiator 210 is formed.

Referring to FIG. 8, the switch 230 may be turned on such that radiation of a second radiator 220 may be performed in a second direction. In this case, the second direction may be a horizontal direction that is perpendicular to a vertical direction in which the second radiator 220 is formed.

As described above, a manufacturing process of the substrate 250 according to an embodiment of the present disclosure is well known, and thus, a description thereof will be omitted below.

When an antenna according to an embodiment of the present disclosure is used, one antenna performs both a vertical radiation function and a horizontal radiation function. Even if one antenna performs the two functions, the antenna may be miniaturized. In addition, an embedded antenna may be used on a single substrate, thereby forming a thinned antenna. Furthermore, one radiator is disposed on a substrate and a radiator is disposed in a perpendicular direction to the radiator, and thus, the antenna performs both a vertical radiation function and a horizontal radiation function, thereby achieving the productivity of the antenna.

Figure 9:
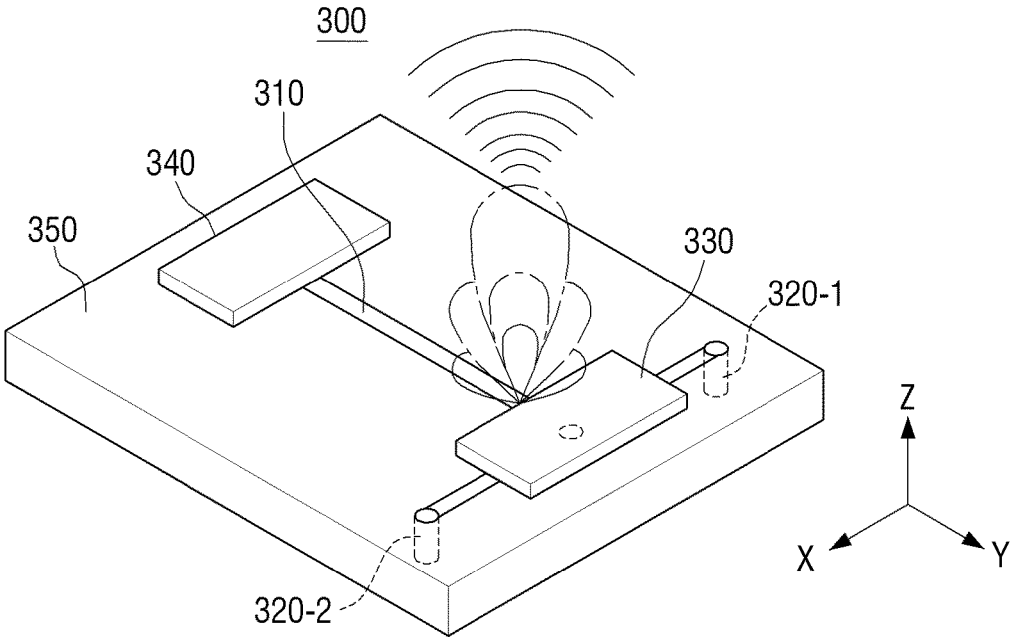
FIGS. 9, 10, and 11 are perspective views of an antenna according to an embodiment of the present disclosure.
Figure 10:
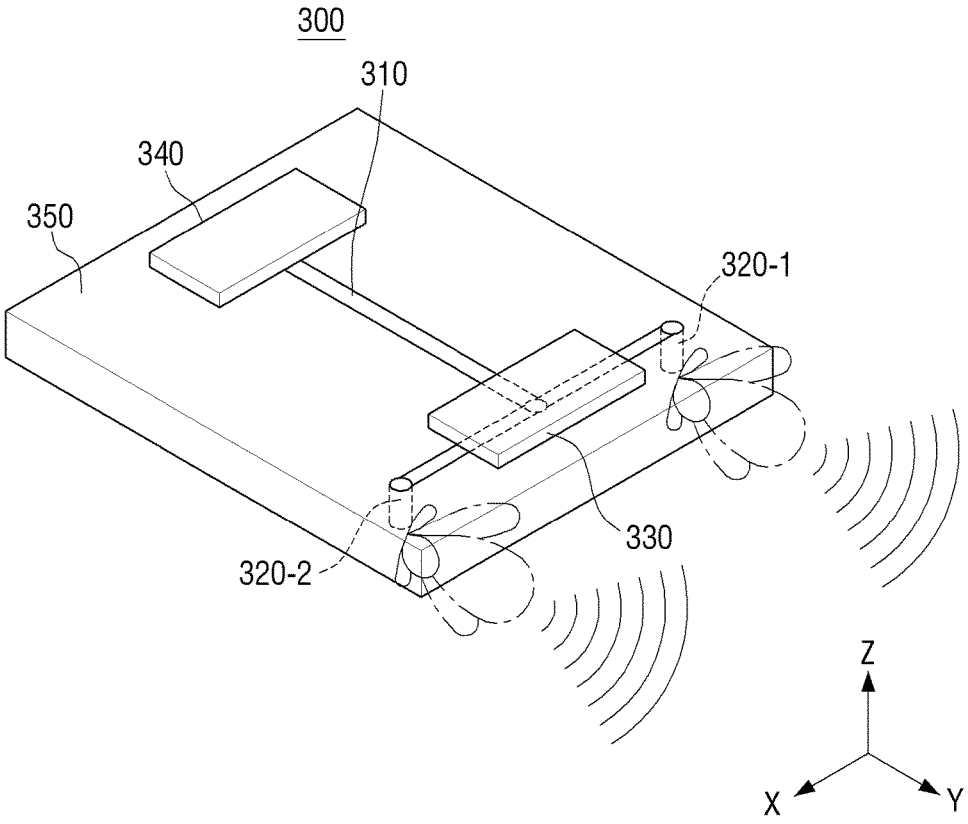
Figure 11:
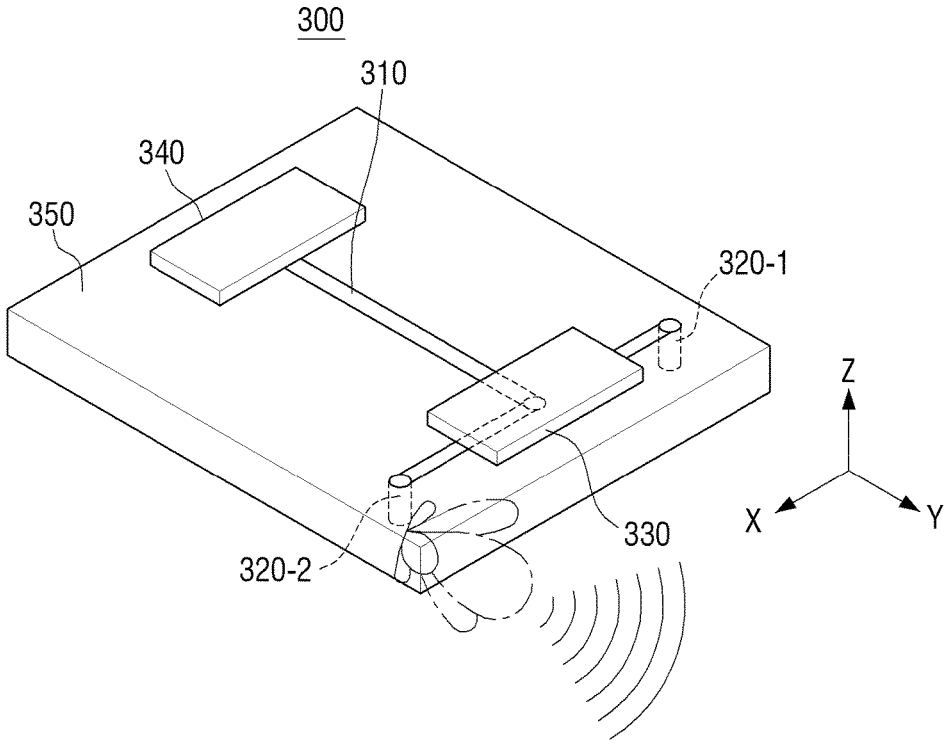

FIGS. 9 to 11 are perspective views of an antenna according to an embodiment of the present disclosure. Hereinafter, a repeated description of the above description will be omitted.

Referring to FIGS. 9 to 11, an antenna 300 according to an embodiment of the present disclosure includes a current feeder 340, a switch 330, a first radiator 310, a left second radiator 320-1, a right second radiator 320-2, and a substrate 350.

The left second radiator 320-1 is formed on the left of the first radiator 310 in a perpendicular direction to a direction in which the first radiator 310 is formed, and the right second radiator 320-2 is formed on the right of the first radiator 310 in a perpendicular direction to the direction in which the first radiator 310 is formed. End portions of the left second radiator 320-1 and the right second radiator 320-2 may be spaced apart from each other by a predetermined interval.

One side of the switch 330 is connected to the first radiator 310. A left side and a right side of the side of the switch 330, which is connected to the first radiator 310, may be connected to the left second radiator 320-1 and the right second radiator 320-2, respectively.

Referring to FIG. 9, the switch 330 may be turned off, and thus, the first radiator 310 may be spaced apart from the left second radiator 320-1 and the right second radiator 320-2. Thus, electromagnetic energy fed by the current feeder 340 may be lastly transmitted to the first radiator 310, and the first radiator 310 receiving electromagnetic energy may generate electromagnetic wave at an opposite end portion to a portion connected to the current feeder 340. In this case, radiation of the first radiator 310 may be performed in a first direction, and the first direction may be a perpendicular direction to a direction in which the first radiator 310 is formed. Thus, when the switch 330 is turned off, vertical radiation may be performed.

Referring to FIG. 10, the switch 330 is turned on, and thus, the first radiator 310 may be connected to the left second radiator 320-1 and the right second radiator 320-2. Thus, electromagnetic energy fed by the current feeder 340 may be lastly transmitted to the left second radiator 320-1 and the right second radiator 320-2, and the left second radiator 320-1 and the right second radiator 320-2 that receive electromagnetic energy may generate electromagnetic wave at an opposite end portion to a portion connected to the current feeder 340. In this case, radiation of the left second radiator 320-1 and the right second radiator 320-2 may be performed in a second direction, and the second direction may be a horizontal direction that is perpendicular to the vertical direction in which the left second radiator 320-1 and the right second radiator 320-2 are formed. Thus, when the switch 330 is turned on, horizontal radiation may be performed by the left second radiator 320-1 and the right second radiator 320-2.

Referring to FIG. 11, the switch 330 is turned off with respect to the left second radiator 320-1 and is turned on with respect to the right second radiator 320-2, and thus, the first radiator 310 is spaced apart from the left second radiator 320-1 and is connected to the right second radiator 320-2. Thus, electromagnetic energy fed by the current feeder 340 may be lastly transmitted to the right second radiator 320-2, and the right second radiator 320-2 receiving electromagnetic energy may generate electromagnetic wave at an opposite end portion to a portion connected to the current feeder 340. In this case, radiation of the right second radiator 320-2 may be performed in a second direction, and the second direction may be a horizontal direction that is perpendicular to the vertical direction in which the right second radiator 320-2 is formed. Thus, when the switch 330 is turned off with respect to the left second radiator 320-1 and is turned on with respect to the right second radiator 320-2, horizontal radiation may be performed by the right second radiator 320-2.

FIGS. 12 to 14A are perspective views of an antenna according to an embodiment of the present disclosure. Hereinafter, a repeated description of the above description will be omitted.

Referring to FIGS. 12 to 14A, an antenna 400 according to an embodiment of the present disclosure includes a current feeder 440, a substrate 450, a left switch 430-1, a right switch 430-2, a left first radiator 410-1, a right first radiator 410-2, a left second radiator 420-1, and a right second radiator 420-2.

The current feeder 440 is connected to the left first radiator 410-1 and the right first radiator 410-2 and feeds electromagnetic energy to the left first radiator 410-1 and the right first radiator 410-2. In this case, the current feeder 440 may include a left current feeder 440 connected to the left first radiator 410-1 and a right current feeder 440 connected to the right first radiator 410-2.

The left first radiator 410-1 may be connected to the left switch 430-1 and may be connected to or spaced apart from the left second radiator 420-1 by the left switch 430-1. In addition, the right first radiator 410-2 may be connected to the right switch 430-2 and may be connected to or spaced apart from the right second radiator 420-2 by the right switch 430-2.

The left second radiator 420-1 is formed in a perpendicular direction to a direction in which the left first radiator 410-1 is formed, and the right second radiator 420-2 is formed in a perpendicular direction to a direction in which the right first radiator 410-2 is formed. End portions of the left second radiator 420-1 and the right second radiator 420-2 may be spaced apart by a predetermined interval.

Figure 12:
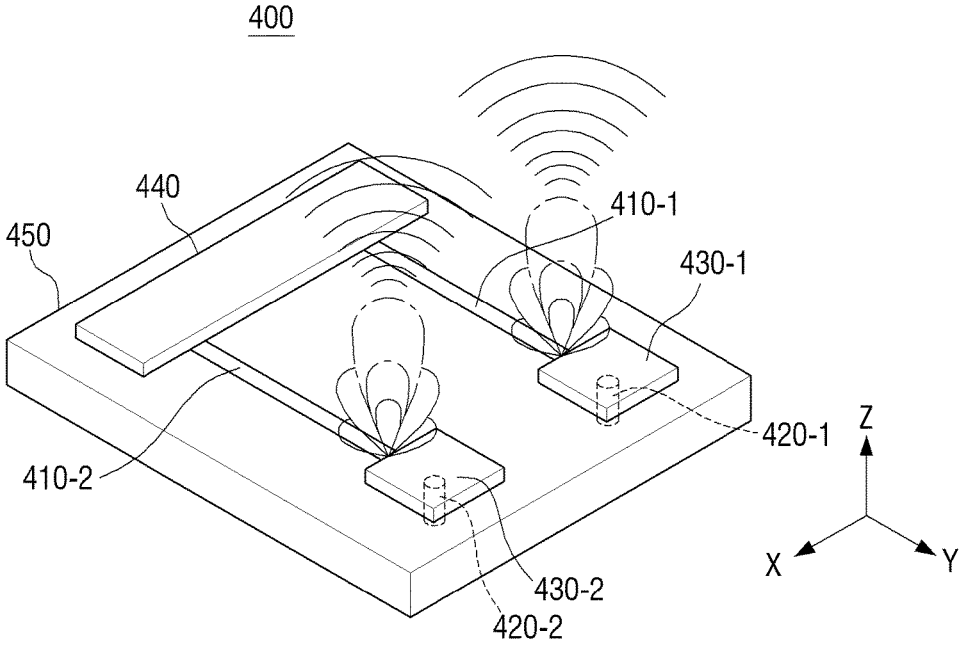
FIGS. 12, 13, and 14A are perspective views of an antenna according to an embodiment of the present disclosure.

Referring to FIG. 12, the left switch 430-1 and the right switch 430-2 are turned off with respect to the left first radiator 410-1 and the right first radiator 410-2, respectively, and thus, the left first radiator 410-1 is spaced apart from the left second radiator 420-1, and the right first radiator 410-2 is spaced apart from the right second radiator 420-2. Thus, electromagnetic energy fed by the current feeder 440 may be lastly transmitted to the left first radiator 410-1 and the right first radiator 410-2, and the left first radiator 410-1 and the right first radiator 410-2 that receive electromagnetic energy may generate electromagnetic wave at an opposite end portion to a portion to which the current feeder 440 is connected. In this case, the left first radiator 410-1 and the right first radiator 410-2 may be disposed in parallel to each other, radiation may be performed in a first direction by the left first radiator 410-1 and the right first radiator 410-2, and the first direction may be a vertical direction that is perpendicular to a direction in which the left first radiator 410-1 and the right first radiator 410-2 are formed. Thus, when the left switch 430-1 and the right switch 430-2 are turned off with respect to the left first radiator 410-1 and the right first radiator 410-2, respectively, vertical radiation may be performed by the left first radiator 410-1 and the right first radiator 410-2.

Figure 13:
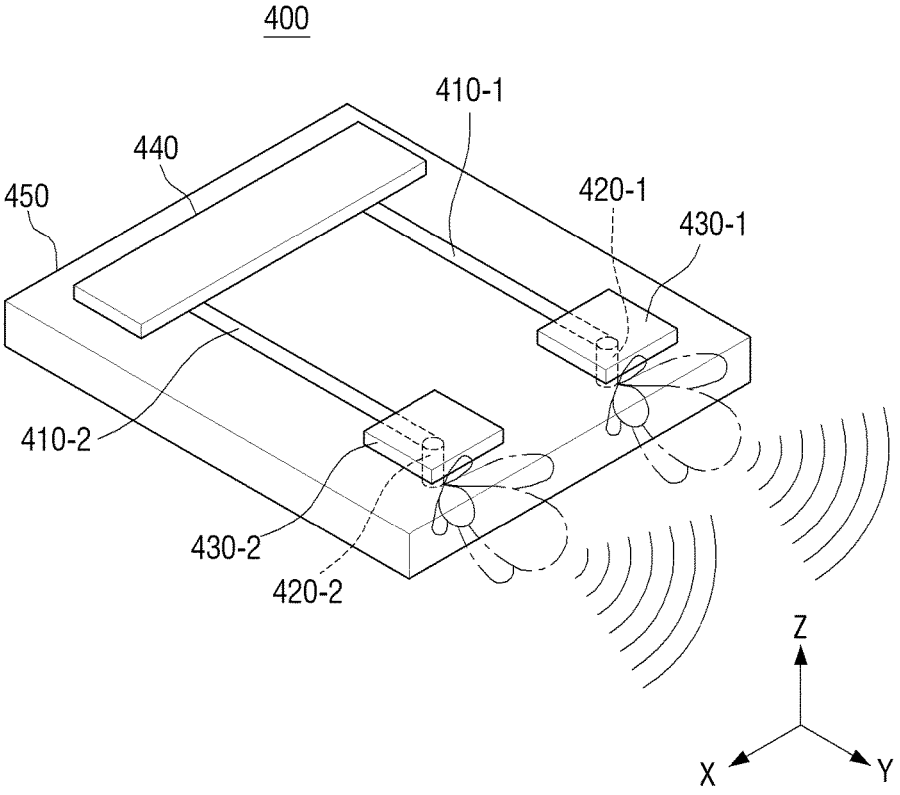

Referring to FIG. 13, the left switch 430-1 and the right switch 430-2 are turned on with respect to the left first radiator 410-1 and the right first radiator 410-2, respectively, and thus, the left first radiator 410-1 is connected to the left second radiator 420-1 and the right first radiator 410-2 is connected to the right second radiator 420-2. Thus, electromagnetic energy fed by the current feeder 440 may be lastly transmitted to the left second radiator 420-1 and the right second radiator 420-2, and the left second radiator 420-1 and the right second radiator 420-2 that receive electromagnetic energy may generate electromagnetic wave at an opposite end portion to a portion connected to the current feeder 440. In this case, the left second radiator 420-1 and the right second radiator 420-2 may be disposed in parallel to each other, radiation may be performed in a second direction by the left second radiator 420-1 and the right second radiator 420-2, and the second direction may be a horizontal direction perpendicular to a vertical direction in which the left second radiator 420-1 and the right second radiator 420-2 are formed. Thus, when the left switch 430-1 and the right switch 430-2 are turned on with respect to the left first radiator 410-1 and the right first radiator 410-2, respectively, horizontal radiation may be performed by the left second radiator 420-1 and the right second radiator 420-2.

Figure 14:
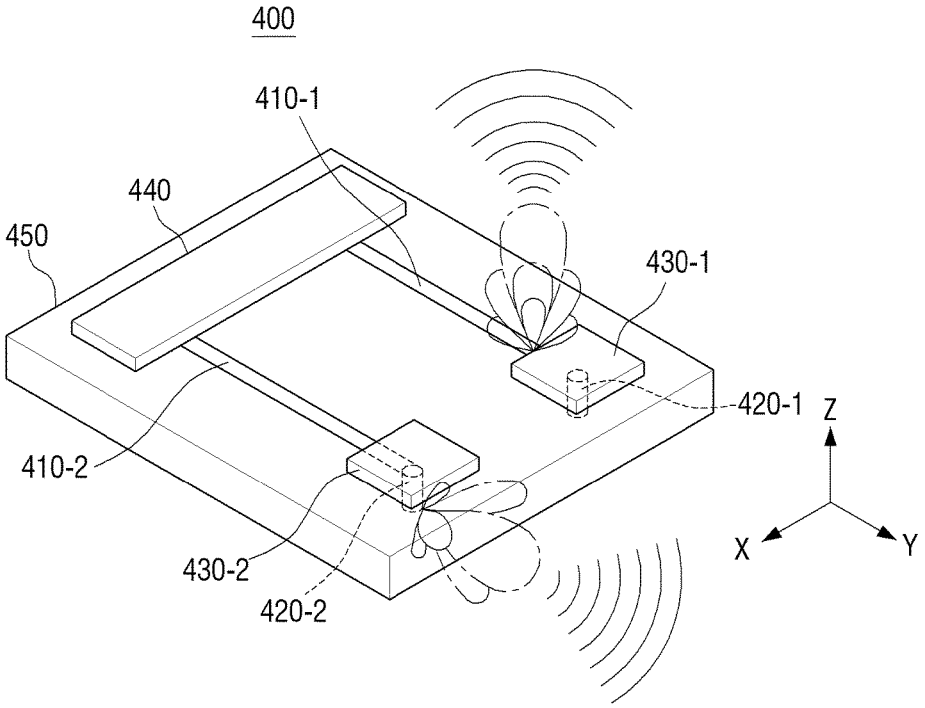
FIG. 14B is a block diagram illustrating an antenna according to an embodiment of the present disclosure.
Figure 14A:
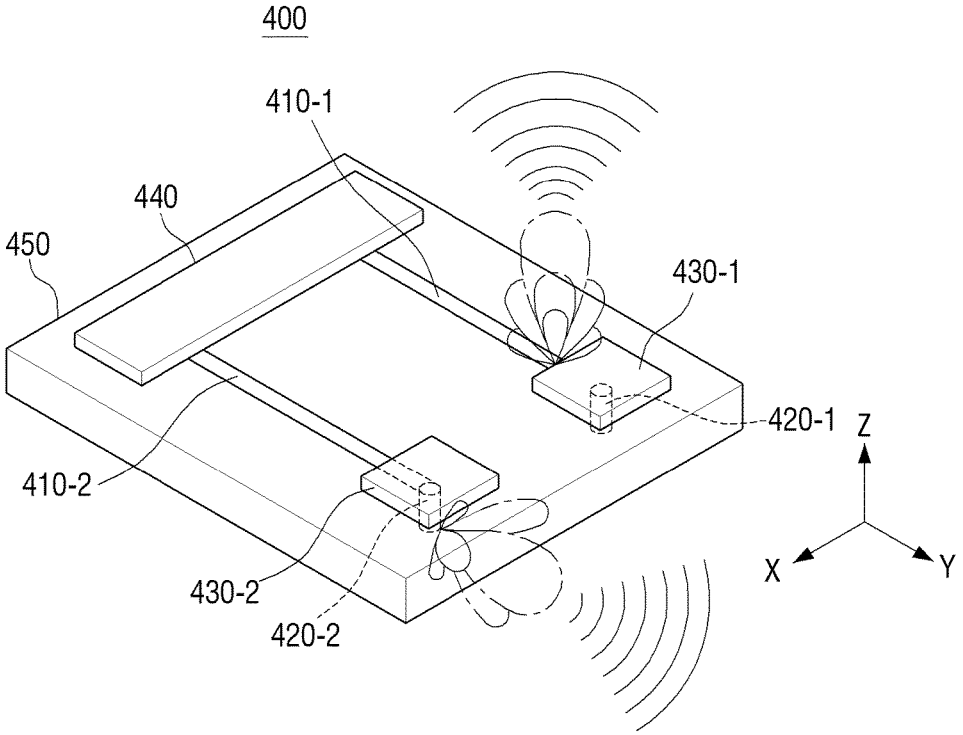

Referring to FIG. 14A, since the left switch 430-1 is turned off with respect to the left first radiator 410-1, the left first radiator 410-1 and the left second radiator 420-1 are spaced apart from each other, and since the right switch 430-2 is turned on with respect to the right first radiator 410-2, the right first radiator 410-2 and the right second radiator 420-2 are connected to each other. Thus, electromagnetic energy fed by the current feeder 440 may be lastly transmitted to the left first radiator 410-1 and the right second radiator 420-2, and the left first radiator 410-1 and the right second radiator 420-2 that receive electromagnetic energy may generate at an opposite end portion to a portion connected to the current feeder 440. In this case, radiation may be performed in a first direction by the left first radiator 410-1 and may be performed in a second direction by the right second radiator 420-2. The first direction may be a perpendicular direction to a horizontal direction in which a first radiator is formed, and the second direction may be a horizontal direction perpendicular to a vertical direction in which the right second radiator 420-2 is formed. Thus, when the left switch 430-1 is turned off with respect to the left first radiator 410-1 and the right switch 430-2 is turned on with respect to the right first radiator 410-2, vertical radiation of the left first radiator 410-1 and horizontal radiation of the right second radiator 420-2 may be simultaneously performed.

Thus far, the case in which two first radiators and two second radiators are used has been exemplified. However, needless to say, two or more first radiator and second radiator may be used.

Thus, when the antenna 400 according to an embodiment of the present disclosure is used, one antenna performs both a vertical radiation function and a horizontal radiation function. Even if one antenna performs the two functions, the antenna may be miniaturized. In addition, an embedded antenna may be used on a single substrate, thereby forming a thinned antenna.

Vertical radiation with high gain may be achieved by the plural first radiators 410-1 and 410-2, horizontal with high gain may be achieved by the plural second radiators 420-1 and 420-2, and vertical radiation and horizontal radiation may be simultaneously achieved by one or more first radiator and one or more second radiator.

Figure 14B:
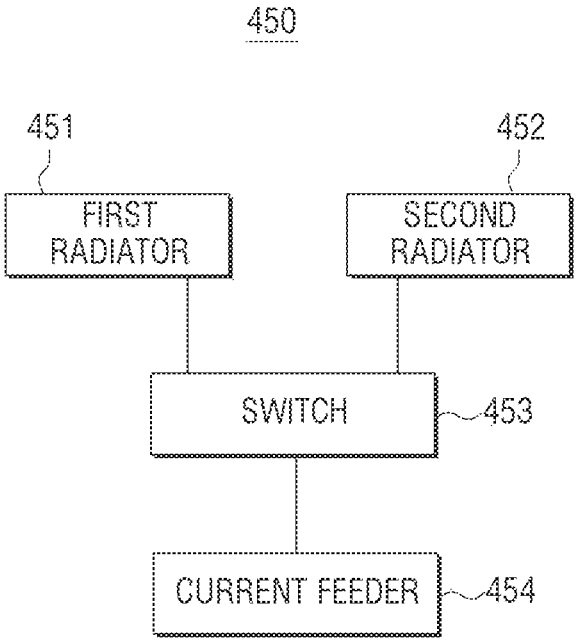

FIG. 14B is a block diagram illustrating an antenna according to an embodiment of the present disclosure.

Referring to FIG. 14B, an antenna 450 according to an embodiment of the present disclosure includes a first radiator 451, a second radiator 452, a switch 453, and a current feeder 454.

The first radiator 451, the second radiator 452, and the current feeder 454 are the same as in the aforementioned embodiments, and a repeated description will be omitted.

However, the switch 453 electrically connects or disconnects at least one of the first radiator 451 and the second radiator 452 to or from the current feeder 454. To this end, the switch 453 may include a first switch (not shown) and a second switch that are connected to the first radiator 451 and the second radiator 452, respectively.

When the first switch is turned on, the first radiator 451 may be electrically connected to the current feeder 454. On the other hand, when the second switch is turned on, the second radiator 452 may be electrically connected to the current feeder 454. When both the first switch and the second switch are turned on, both the first radiator 451 and the second radiator 452 may be electrically connected to the current feeder 454 to form one radiator.

The switch 453 may connect the current feeder 454 to the first radiator 451 so as to control the first radiator 451 to radiate electromagnetic wave in a first direction. In addition, the switch 453 may connect the current feeder 454 to the second radiator 452 so as to control the second radiator 452 to radiate electromagnetic wave in a second direction. In this case, the first direction and the second may be perpendicular to each other.

Figure 15:
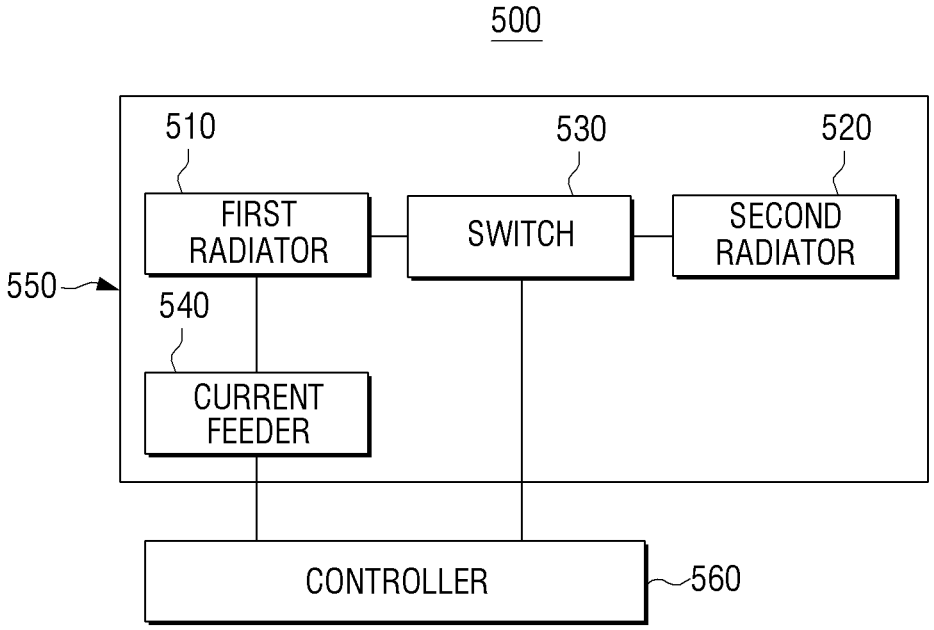
FIG. 15 is a block diagram of a wireless communication apparatus according to an embodiment of the present disclosure.

FIG. 15 is a block diagram of a wireless communication apparatus according to an embodiment of the present disclosure.

Referring to FIG. 15, a user terminal apparatus 500 according to an embodiment of the present disclosure includes an antenna 550 and a controller 560.

The antenna 550 may include a first radiator 510, a second radiator 520, a current feeder 540, and a switch 530 and radiate electromagnetic wave in a first direction, a second direction, or first and second directions. This has been already described with reference to FIGS. 3B to 14A, and thus, a repeated description will be omitted.

The controller 560 may be connected to the current feeder 540 to control feed of electromagnetic energy to the first radiator 510 or the second radiator 520. That is, when the antenna 550 receives electromagnetic wave from the outside, the controller 560 may control the current feeder 540 to feed electromagnetic energy to the first radiator 510 or the second radiator 520, and when the antenna 550 transmits electromagnetic wave to the outside, the antenna 550 may control the current feeder 540 to feed electromagnetic energy to the first radiator 510 or the second radiator 520.

The controller 560 may be connected to the switch 530 to control a radiation direction of electromagnetic wave. The radiation direction of electromagnetic wave may be any one of a first direction and a second direction and may include both the first direction and the second direction. Here, the first direction is a direction in which vertical radiation is performed and radiation in the first direction is referred to as broadside radiation. In addition, the second radiation is a direction in which horizontal radiation is performed and radiation in the second direction is referred to as end-fire radiation.

Here, sometimes, electromagnetic wave transmitted to the outside by the antenna 550 may need to be transmitted in various directions instead of a specific direction, and electromagnetic wave received from the outside by the antenna 550 may need to be received in various directions instead of a specific direction. That is, sometimes, a first event in which electromagnetic wave needs to be radiated in a first direction may occur, and a second event in which electromagnetic wave needs to be radiated in a second direction may occur. In this case, the first event may refer to a case in which vertical radiation, that is, broadside radiation is needed, and the second event may refer to a case in which horizontal radiation, that is, end-fire ration is needed.

When the adjuster includes a switch (530), the controller 560 may control the switch to be turned on/off in a predetermined time unit. That is, when predetermined time is 1 μSec, the controller may control the switch (530) to turn on/off a first radiator with a period of 1 μSec. Accordingly, in this case, the antenna 550 may perform broadside radiation with a period of 1 μSec with respect to the first event and perform end-fire radiation with a period of 1 μSec with respect to the second event.

In addition, when output of transmitted or received electromagnetic wave is less than a value, the controller 560 may control the switch to perform switching. That is, when electromagnetic wave that is equal to or greater than a predetermined value is transmitted or received, the controller 560 may control the switch not to perform switching, and when electromagnetic wave less than a predetermined threshold value is transmitted or received, the controller 560 may control the switch to perform switching.

When end-fire radiation is required, use of a broad-side antenna is inappropriate, and when broadside radiation is required, use of an end-fire antenna is inappropriate. Thus, it is required to simultaneously embody both a broad-side antenna and an end-fire antenna in one wireless communication apparatus 500. Thus, in the wireless communication apparatus 500 according to an embodiment of the present disclosure, the controller 560 may turn off the switch 530 when the first event in which radiation is needed in a first direction occurs, and turn on the switch 530 when the second even in which radiation is needed in a second direction occurs.

As described above, according to an embodiment of the present disclosure, since radiation in the first direction and radiation in the second direction may be simultaneously achieved, both broadside radiation and end-fire radiation may be simultaneously achieved.

Figure 15A:
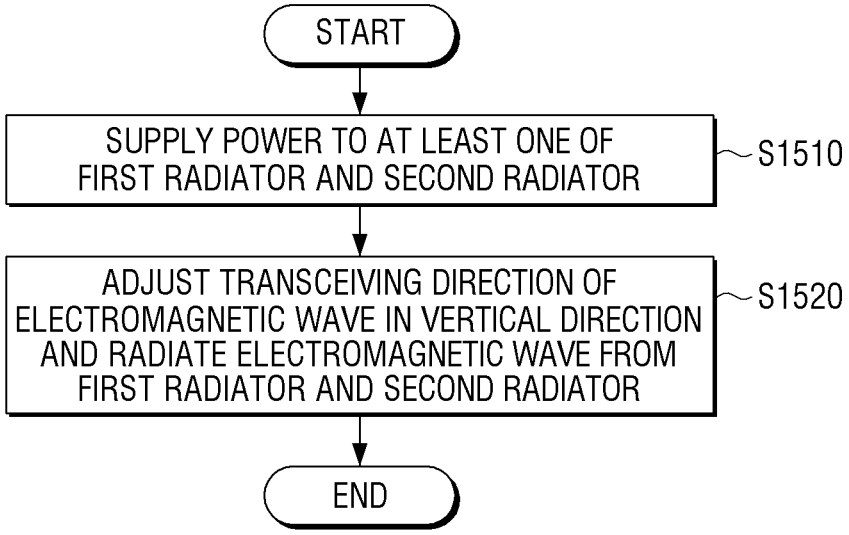
FIG. 15A is a flowchart of a wireless communication method according to an embodiment of the present disclosure.

FIG. 15A is a flowchart of a wireless communication method according to an embodiment of the present disclosure. Hereinafter, a repeated description of the above description will be omitted.

Referring to FIG. 15A, power is supplied to at least one of a first radiator and a second radiator in operation S1510. Transceiving directions of electromagnetic wave transmitted and received to and from the first radiator and the second radiator are adjusted to be perpendicular to each other and the electromagnetic waves are transmitted and received in operation S1520.

Figure 16:
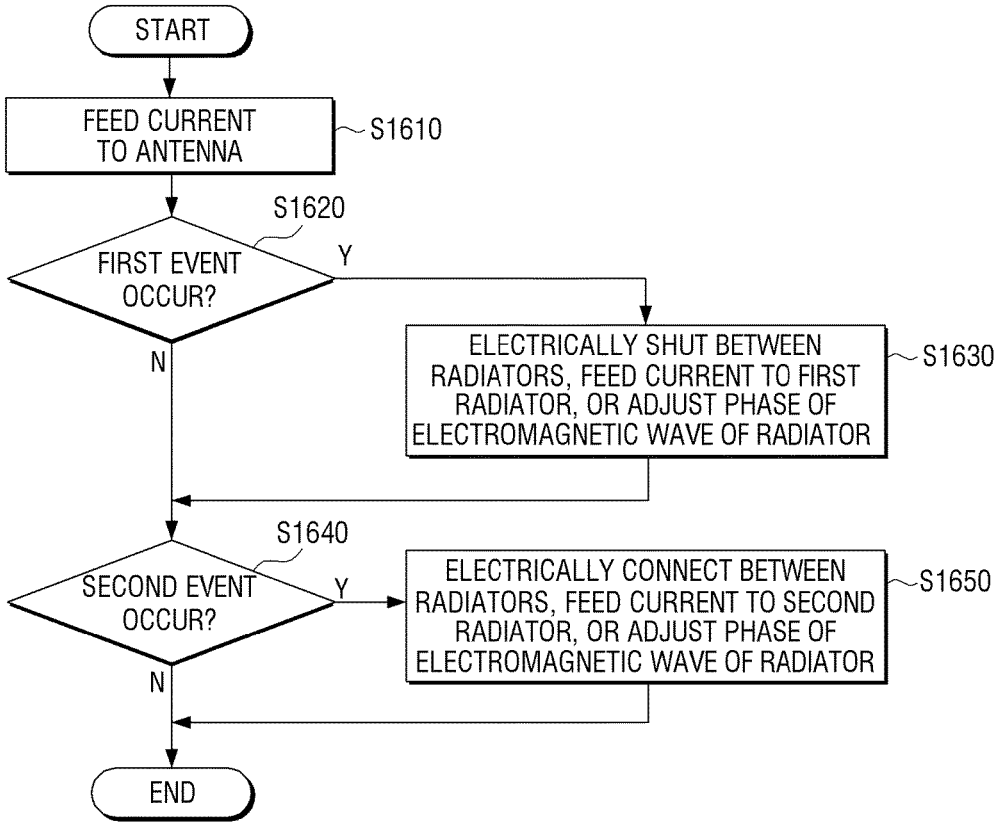
FIG. 16 is a flowchart of a wireless communication method according to an embodiment of the present disclosure.

FIG. 16 is a flowchart of a wireless communication method according to an embodiment of the present disclosure. Hereinafter, a repeated description of the above description will be omitted.

Referring to FIG. 16, current is fed to an antenna in operation S1610. The antenna includes a switch, a first radiator, a second radiator, and an adjuster.

Whether a first event in which electromagnetic wave needs to be radiated in a first direction occurs may be determined in operation S1620. When the first event occurs in operation S1620-Y, 1) the first radiator and the second radiator are electrically disconnected from each other, 2) the first radiator is electrically connected to the current feeder, or 3) a phase of electromagnetic wave transmitted and received to and from at least one of the first radiator and the second radiator is adjusted in operation S1630.

1) When the first radiator and the second radiator are electrically disconnected from each other, only the first radiator is connected to the current feeder. In this case, the first radiator generates electromagnetic wave in a first direction, and does not generate electromagnetic wave in a direction.

2) The case in which the first radiator is electrically connected to the current feeder is the same as in 1) above. In this case, the first radiator generates electromagnetic wave in the first direction, and does not generate electromagnetic wave in a direction.

3) When a phase of electromagnetic wave transmitted and received to and from at least one of the first radiator and the second radiator is adjusted, a direction of electromagnetic wave transmitted and received to and from at least one of the first radiator and the second radiator may become the first direction via the phase adjustment.

Whether a second event in which electromagnetic wave in a second direction needs to be radiated occurs independently from the occurrence of the first event may be determined in operation S1640. When the second event occurs in operation S1640-Y, 1) the first radiator and the second radiator are electrically connected to each other, 2) the second radiator is electrically connected to the current feeder, or 3) a phase of electromagnetic wave transmitted and received to and from at least one of the first radiator and the second radiator is adjusted in operation S1650.

1) When the first radiator and the second radiator are electrically connected to each other, the first radiator is connected to the second radiator and the first radiator is connected to the current feeder, and thus, power is also supplied to the second radiator. In this case, the first radiator generates electromagnetic wave in a first direction and the second radiator generates electromagnetic wave in a second direction.

2) When the second radiator is electrically connected to the current feeder, the second radiator generates electromagnetic wave in the second direction. When the first radiator is also connected to the current feeder, the first radiator also generates electromagnetic wave in the first direction and simultaneously generates electromagnetic wave in a direction perpendicular to the first direction.

3) When a phase of electromagnetic wave transmitted and received to and from at least one of the first radiator and the second radiator is adjusted, a direction of electromagnetic wave transmitted and received to and from at least one of the first radiator and the second radiator may become the second direction via the phase adjustment.

Phases of electromagnetic waves of the first radiator and the second radiator may be differently adjusted. In this case, a direction of the electromagnetic wave transmitted and received to and from the first radiator may become the first direction via the phase adjustment, and a direction of the electromagnetic wave transmitted and received to and from the second radiator may be become the second direction via the phase adjustment.

Figure 17:
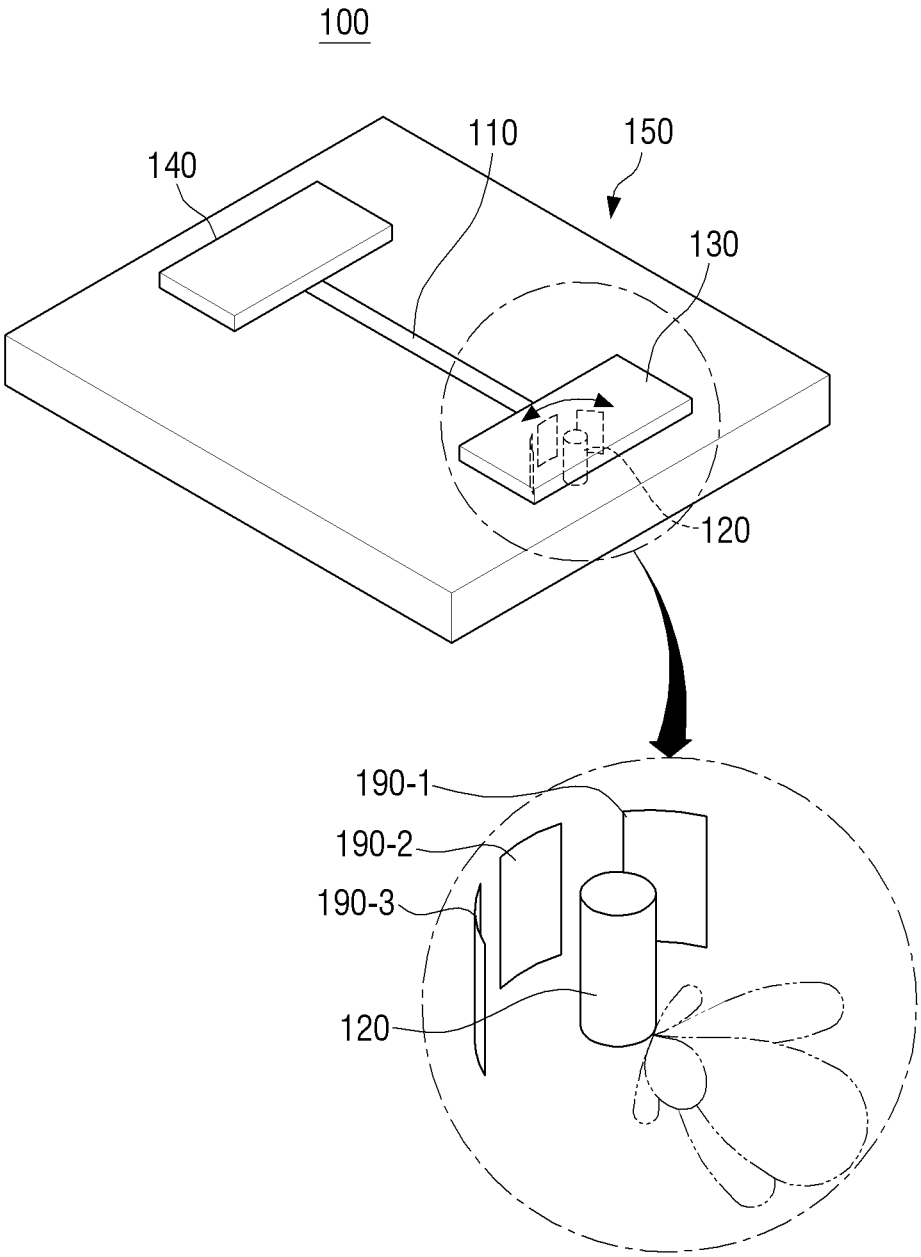
FIG. 17 is a perspective view of an antenna according to an embodiment of the present disclosure.

FIG. 17 is a perspective view of an antenna according to an embodiment of the present disclosure. Hereinafter, a repeated description of the description of FIG. 4 will be omitted.

Referring to FIG. 17, an antenna 100 according to an embodiment of the present disclosure may further include reflecting plates 190-1, 190-2, and 190-3. The reflecting plates 190-1, 190-2, and 190-3 may reflect electromagnetic wave transmitted from a second radiator 120 to concentrate in a desired direction or reflect and concentrate electromagnetic wave radiated in various directions such that the second radiator 120 receives the electromagnetic wave.

The reflecting plates 190-1, 190-2, and 190-3 may be formed in the same manner as that of the second radiator 120. That is, as described above with reference to a method of forming the second radiator 120, an electroconductive material is filled in a via hole formed in the substrate 150 to form the second radiator 120. At least one via hole may be formed around the second radiator 120. In particular, as illustrated n FIG. 17, at least another via hole may be formed at an opposite side to an edge of the substrate 150 based on the second radiator 120. That is, the second radiator 120 may be formed between one side of the edge of the substrate 150 and the reflecting plates 190-1, 190-2, and 190-3. A material for reflecting electromagnetic wave may be filled in the formed another via hole to form the reflecting plates 190-1, 190-2, and 190-3.

A height of each of the reflecting plates 190-1, 190-2, and 190-3 may be the same as a height of the second radiator 120. In addition, the reflecting plates 190-1, 190-2, and 190-3 may each have a predetermined curvature. Thus, the reflecting plates 190-1, 190-2, and 190-3 are each formed with a predetermined curvature, and thus the reflecting plates 190-1, 190-2, and 190-3 may reflect electromagnetic wave transmitted and received to and from the second radiator 120 and adjust a radiation direction of the electromagnetic wave. In this case, one surface of each of the reflecting plates 190-1, 190-2, and 190-3 facing the second radiator 120 may have a curvature. That is, as illustrated in FIG. 17, the reflecting plates 190-1, 190-2, and 190-3 may be shaped to surround the second radiator 120.

At least one reflecting plate may be used. That is, one reflecting plate may be formed to reflect electromagnetic wave transmitted and received to and from the second radiator 120 or a plurality of reflecting plates may be formed at a predetermined location to reflect electromagnetic wave transmitted and received to and from the second radiator 120.

Thus, if the reflecting plates 190-1, 190-2, and 190-3 are not present, electromagnetic wave transmitted and received to and from the second radiator 120 is radiated to various spaces, and thus, sensitivity for the electromagnetic wave is inevitably low. However, if the reflecting plates 190-1, 190-2, and 190-3 are present, electromagnetic wave transmitted from the second radiator 120 is radiated in a second direction that is opposite to a direction in which the reflecting plates 190-1, 190-2, and 190-3 are formed, and thus, electromagnetic wave with high sensitivity may be transmitted in a desired direction. The same principle is also applied to the case in which the second radiator 120 receives electromagnetic wave.

Figure 18:
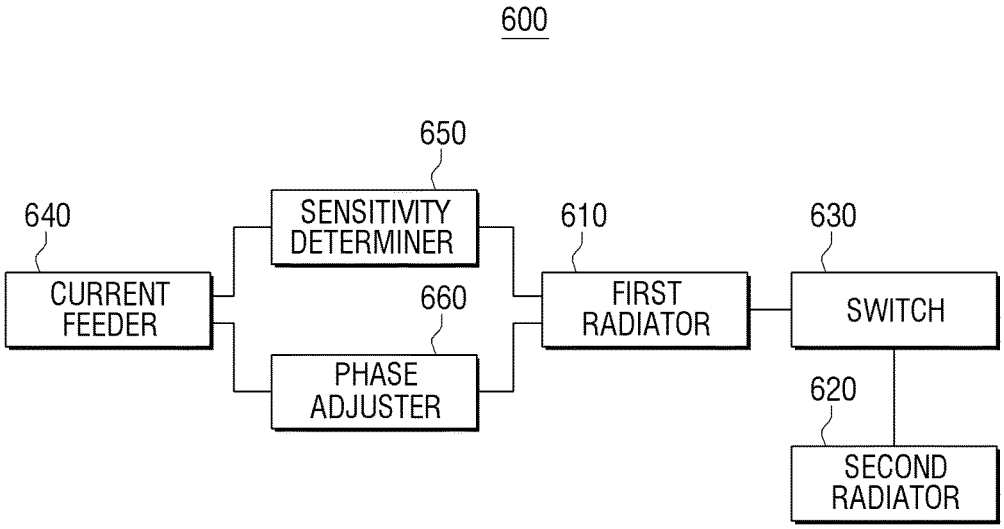
FIG. 18 is a block diagram of an antenna according to an embodiment of the present disclosure.

FIG. 18 is a block diagram of an antenna according to an embodiment of the present disclosure. The block diagram illustrated in FIG. 18 includes elements similar to elements described in the description of the block diagram illustrated in FIG. 3B. Thus, a repeated description of such elements will be omitted herein.

Referring to FIG. 18, an antenna 600 according to an embodiment of the present disclosure may further include a sensitivity detector 650 and a phase adjuster 660. Like, the embodiments described above the antenna 600 also includes a first and second radiators 610 and 620 and switch 630.

A sensitivity determiner 650 may determine the sensitivity of electromagnetic wave detected by a radiator. When a first radiator 610 or a second radiator 620 transmits and receives electromagnetic wave, the sensitivity determiner 650 may scan signals in various directions and then determine a direction corresponding to highest signal sensitivity. That is, the sensitivity determiner 650 may determine transceiving sensitivity of electromagnetic wave transmitted and received to and from the first radiator 610 or the second radiator 620 and detect a direction corresponding to highest signal sensitivity. The detection result of the sensitivity determiner 650 is transmitted to the phase adjuster 660.

The phase adjuster 660 may receive the detection result obtained by the sensitivity determiner 650 and control a radiator phase according to the detection result. When the radiator phase is adjusted, a radiation pattern of electromagnetic wave transmitted and received to and from a radiator may be changed. That is, the phase adjuster 660 may adjust a phase of each of a plurality of adjacent radiators to form tilt with respect to the radiation pattern. The phase adjuster 660 will be described in detail with reference to FIGS. 19 and 20.

Figure 19:
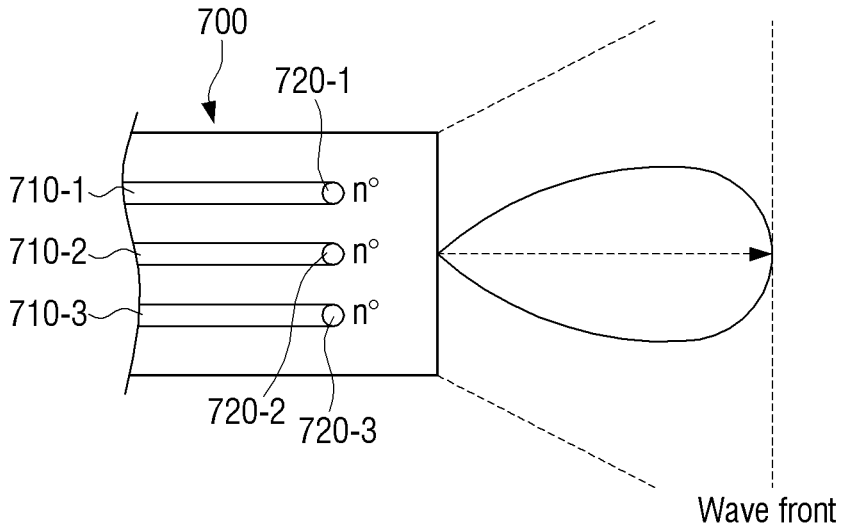
FIGS. 19 and 20 are diagrams illustrating a radiation pattern of an antenna according to various embodiments of the present disclosure.
Figure 20:
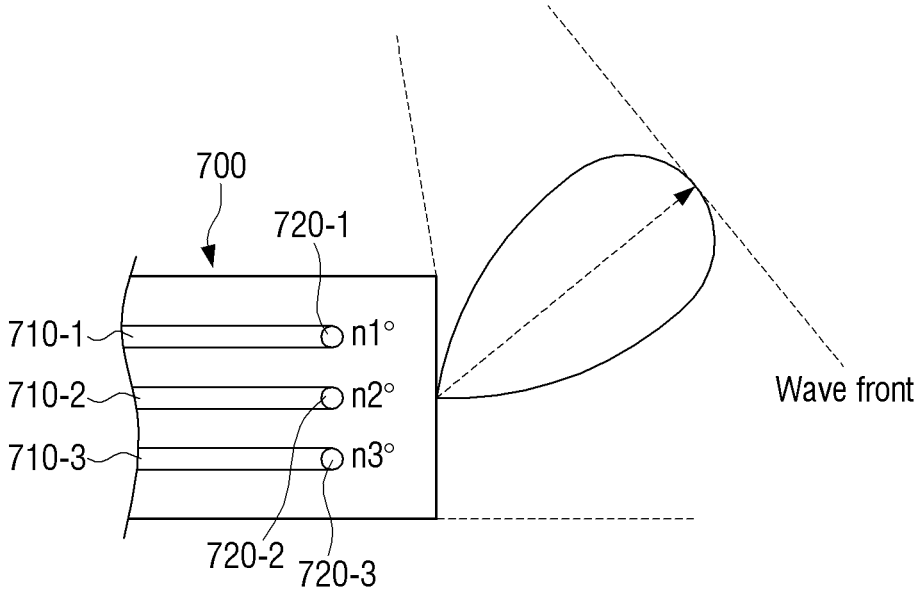

FIGS. 19 and 20 are diagrams illustrating a radiation pattern of an antenna according to various embodiments of the present disclosure. In FIGS. 19 to 20, one antenna 700 includes three radiators 710-1, 720-2, and 720-3 that are formed adjacent to each other, but embodiments of the present disclosure are not limited thereto. That is, a plurality of radiators may be formed adjacent to each other in one antenna 700. Since a plurality of radiators is adjacent to each other, the size, the phase, etc. of electromagnetic wave transmitted and received to and from each radiator may affect the size, the phase, etc. of electromagnetic wave transmitted and received to and from one antenna 700.

Referring to FIG. 19, phases of the three adjacent radiators 710-1, 720-2, and 720-3 are the same. When a phase of electromagnetic wave transmitted and received to and from one radiator is n [degree], it may be assumed that a wave front of the corresponding electromagnetic wave is formed as illustrated in FIG. 19. In this case, when phases of electromagnetic waves transmitted and received to and from the three adjacent radiators 710-1, 720-2, and 720-3 are the same, wave fronts of the three radiators 710-1, 720-2, and 720-3 may also be the same. Thus, a total electromagnetic wave obtained by combining the electromagnetic waves transmitted and received to and from the three adjacent radiators 710-1, 720-2, and 720-3 are obtained by combining sizes without a change in phase, and thus, the size of a main lobe increases and tilt does not change. That is, when phases of electromagnetic waves transmitted and received to and from a plurality of adjacent radiators are the same, tilt does not change and the size of a main lobe increases.

Referring to FIG. 20, phases of the three adjacent radiators 710-1, 720-2, and 720-3 are different. When a phase of electromagnetic wave transmitted and received to and from one radiator is n [degree], it may be assumed that a wave front of the corresponding electromagnetic wave is formed as illustrated in FIG. 19. In this case, when phases of electromagnetic waves transmitted and received to and from the three adjacent radiators 710-1, 720-2, and 720-3 are different, wave fronts of the three adjacent radiators 710-1, 720-2, and 720-3 may also become different from each other. Thus, a phase of a total electromagnetic wave obtained by combining the electromagnetic waves transmitted and received to and from the three adjacent radiators 710-1, 720-2, and 720-3 changes, and thus, the size of a main lobe increases and tilt changes. That is, when phases of electromagnetic waves transmitted and received to and from a plurality of adjacent radiators are different, tilt changes and the size of a main lobe also increases.

As described above, a sensitivity determiner may detect a direction corresponding electromagnetic wave with highest sensitivity, transmitted and received to and from a radiator, and a phase adjuster may adjust electromagnetic wave transmitted and received by the radiator to tilt in the direction detected by the sensitivity determiner. Accordingly, the sensitivity of the electromagnetic wave transmitted and received by the radiator may be increased by the phase adjuster.

Thus far, change in radiation pattern of electromagnetic wave of one antenna via adjustment of phases of a plurality of radiators when one antenna includes a plurality of radiators has been described. However, embodiments of the present disclosure are not limited thereto. That is, the above principle may also be applied to a case in which each of a plurality of adjacent antennas includes one radiator or a case in which each of a plurality of adjacent antennas includes a plurality of radiators.

In addition, with reference to FIGS. 19 and 20, horizontal radiation of the second radiator has been described. However, embodiments of the present disclosure are not limited thereto. That is, although not illustrated, the aforementioned phase adjustment may also be applied to vertical radiation of the first radiation.

Figure 21:
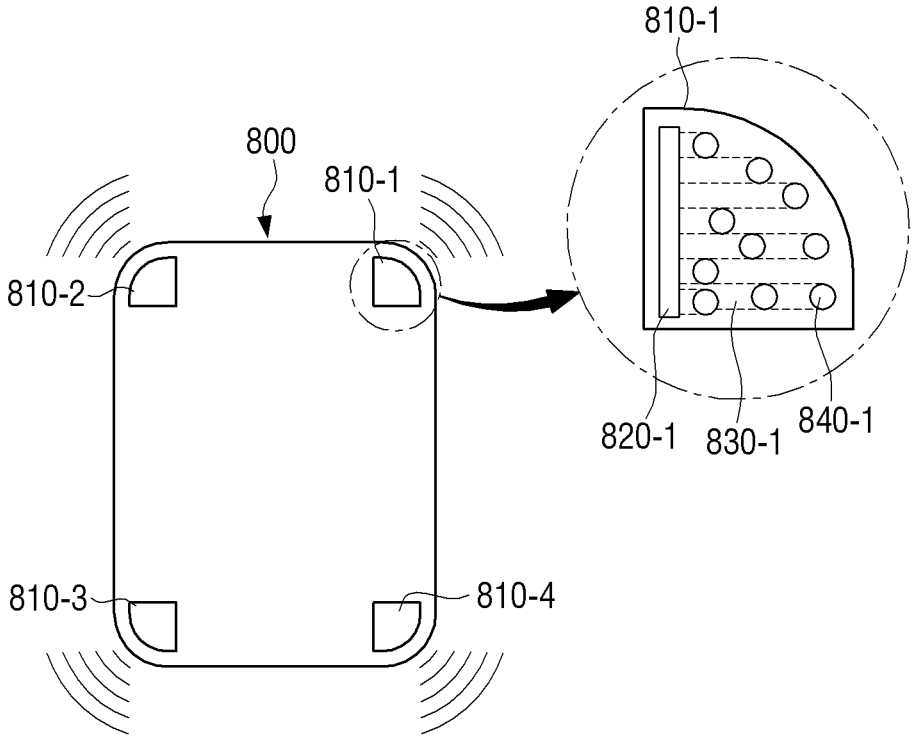
FIGS. 21 and 22 are diagrams illustrating inner arrangement of a user terminal apparatus according to various embodiments of the present disclosure.
Figure 22:
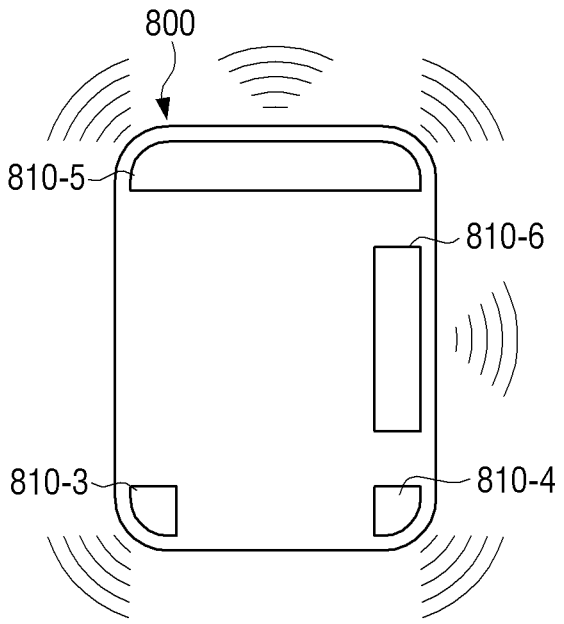

FIGS. 21 and 22 are diagrams illustrating arrangement of antennas inside a wireless communication apparatus according to various embodiments of the present disclosure.

Referring to FIG. 21, a wireless communication apparatus 800 may include a plurality of antennas 810-1, 810-2, 810-3, and 810-4. The wireless communication apparatus 800 may be a typical electronic device that transmits and receives signals. For example, the wireless communication apparatus 800 may be a smart phone, a tablet Personal Computer (PC), a lap-top computer, a smart TV, a smart watch, etc. In general, the wireless communication apparatus 800 may have a rectangular shape, and the plural antennas 810-1, 810-2, 810-3, and 810-4 may be arranged at corner portions of the wireless communication apparatus 800, respectively. In particular, in order to smoothly transmit and receive signals, the plural antennas 810-1, 810-2, 810-3, and 810-4 may be arranged outside the wireless communication apparatus 800. In addition, when the corner portions of the wireless communication apparatus 800 are rounded, antennas arranged at the corner portions of the wireless communication apparatus 800 may have a fan shape, as illustrated in FIG. 21.

One antenna may include at least one radiator, and a plurality of radiators may be arranged at a predetermined intervals. In FIG. 21, the antenna 810-1 arranged at a corner portion of the wireless communication apparatus 800 may include a current feeder 820-1, a plurality of first radiator 830-1, and a plurality of second radiator 840-1. That is, one antenna may be configured in such a way a plurality of radiators is formed, and more radiators are formed toward the edges of the wireless communication apparatus 800.

The example of FIG. 21 is purely exemplary. That is, antennas may be arranged at only some of the four corners of the wireless communication apparatus 800. In addition, at least one antenna may be arranged at an edge of the wireless communication apparatus 800.

Referring to FIG. 22, one antenna 810-5 may be disposed at an upper edge of the wireless communication apparatus 800. In this case, the antenna 810-5 may be disposed at a portion that longitudinally extends between opposite corner portions of the wireless communication apparatus 800. In addition, an antenna 810-6 may be disposed at a left edge and/or a right edge of the wireless communication apparatus 800.

FIGS. 21 and 22 illustrate only the wireless communication apparatus 800 having a rectangular shape. However, embodiments of the present disclosure are not limited thereto. That is, when the wireless communication apparatus 800 has a polygonal shape, a plurality of antennas may be arranged on at least one corner portions. In addition, when the wireless communication apparatus 800 has a circular shape or an oval shape, a plurality of antennas may be arranged outside the wireless communication apparatus 800 at a constant interval.

Figure 23:
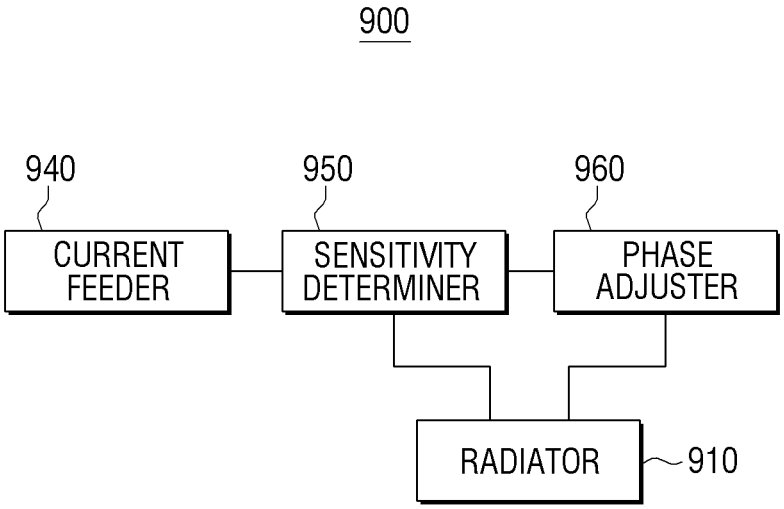
FIG. 23 is a block diagram of an antenna according to an embodiment of the present disclosure.
Figure 24:
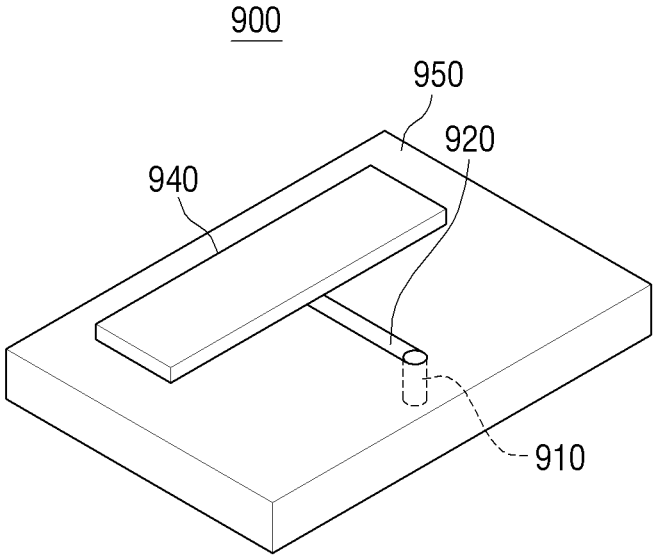
FIG. 24 is a perspective view of an antenna according to an embodiment of the present disclosure.

FIG. 23 is a block diagram of an antenna according to an embodiment of the present disclosure. FIG. 24 is a perspective view of the antenna according to an embodiment of the present disclosure.

Referring to FIGS. 23 and 24, the antenna 900 according to an embodiment of the present disclosure includes a current feeder 940, a sensitivity determiner 950, a phase adjuster 960, and a radiator 910. Hereinafter, a repeated description of the above description will be omitted.

The current feeder 940 may be connected to the radiator 910 to transmit electromagnetic wave to the radiator 910 and transmit the electromagnetic wave to the outside or to receive received electromagnetic wave from the radiator 910.

The sensitivity determiner 950 may scan electromagnetic waves in all directions and measures the sensitivity of the electromagnetic waves. The sensitivity determiner 950 may measure the transceiving sensitivity of electromagnetic wave transmitted and received to and from the radiator 910 and detect a direction corresponding highest transceiving sensitivity. The detection result obtained by the sensitivity determiner 950 is transmitted to the phase adjuster 960.

The phase adjuster 960 may receive the detection result obtained by the sensitivity determiner 950 and control a radiator phase according to the detection result. A plurality of radiators 910 may be formed adjacent to each other in one antenna 900, and the phase adjuster 960 may adjust phases of the plurality adjacent radiator 910 to form tilt with respect to a radiation pattern. The phase adjuster 960 has been described with reference to FIGS. 19 and 20.

The radiator 910 may receive electromagnetic wave from the current feeder 940 and transmit electromagnetic wave to the current feeder 940, which will be described with reference to FIG. 24.

Referring to FIG. 24, a via hole formed in one side of a substrate may be filled with an electroconductive material to form the radiator 910. Here, a signal transmission line 920 for connection between the current feeder 940 and the radiator 910 may be formed on a signal transmission line 920. In this case, the signal transmission line 920 may be formed of the same electroconductive material as the radiator 910. However, the signal transmission line 920 may not be formed on the substrate. In this case, the current feeder 940 and the radiator 910 may be connected directly to each other.

Thus, the radiator 910 may transmit and receive electromagnetic wave in a direction in which the substrate is formed. That is, the radiator 910 is formed in a vertical direction with respect to the substrate, and thus, performs horizontal radiation in the direction in which the substrate is formed. Here, when a wavelength of a resonance frequency is $\lambda$, the length of the radiator 910 may be set to $(n/4)\lambda$. Thus, the length of the radiator 910 $(n/4)\lambda$ (where n is a natural number).

The antenna 900 according to an embodiment may further include a reflecting plate that reflects electromagnetic wave in a predetermined direction.

In addition, a wireless communication apparatus according to an embodiment of the present disclosure may include the antenna 900 that transmits and receives electromagnetic wave, and a controller for control of a radiation direction of electromagnetic wave, and the antenna 900 may include a substrate, the radiator 910, and the current feeder 940, which is the same as in the above description, and thus, a description thereof will be omitted.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna comprising:

a substrate having a surface and a via hole formed on the surface, wherein the via hole starts at the surface and ends within the substrate;

a first antenna element formed on the surface of the substrate and configured to have a first radiation pattern in a first direction;

a second antenna element formed in the via hole of the substrate and configured to have a second radiation pattern in a second direction;

a current feeder, electrically connected to the first antenna element, configured to supply power to the first antenna element; and an adjuster comprising a switch configured to:

electrically connect the first antenna element to the second antenna element to supply the power to the second antenna element through the first antenna element in a first configuration so that the second antenna element emits corresponding electromagnetic waves in the second radiation pattern in the second direction, and electrically disconnect the first antenna element from the second antenna element in a second configuration so that the first antenna element emits corresponding electromagnetic waves in the first radiation pattern in the first direction, wherein the first direction and the second direction are perpendicular to each other.

2. The antenna as claimed in claim 1, wherein at least one of the first antenna element and the second antenna element comprises a plurality of independent antenna elements.

3. The antenna as claimed in claim 1, wherein the first antenna element and the second antenna element are formed of a same electroconductive material, and wherein the first antenna element and the second antenna element are electrically connected to form one antenna element when the switch electrically connects the first antenna element to the second antenna element.

4. The antenna as claimed in claim 1, further comprising:

a third antenna element formed on the surface of the substrate and configured to have a third radiation pattern in a third direction; and a fourth antenna element formed in another via hole of the substrate and configured to have a fourth radiation pattern in a fourth direction, wherein the other via hole starts at the surface and ends within the substrate, wherein the adjuster further comprises another switch configured to:

electrically connect the third antenna element to the fourth antenna element to supply the power to the fourth antenna element through the third antenna element in a third configuration, and electrically disconnect the third antenna element from the fourth antenna element in a fourth configuration, and wherein the first direction and the third direction are parallel to each other, and wherein, in a configuration comprising the second configuration and the fourth configuration, the first antenna element and the second antenna element are configured to transmit and receive electromagnetic waves in parallel according to the first direction and the second direction.

5. The antenna as claimed in claim 1, wherein the adjuster comprises a phase adjuster configured to:

adjust a phase of electromagnetic waves transmitted by at least one of the first antenna element and the second antenna element, and adjust a phase of electromagnetic waves received by the at least one of the first antenna element and the second antenna element.

6. The antenna as claimed in claim 5, further comprising:

a sensitivity determiner configured to:

determine a strength of the electromagnetic waves transmitted by the at least one of the first antenna element and the second antenna element, and determine a strength of the electromagnetic waves received by the at least one of the first antenna element and the second antenna element, wherein the phase adjuster adjusts a phase of the electromagnetic waves transmitted and the electromagnetic waves received according to the corresponding determined strength.

7. The antenna as claimed in claim 1, wherein the first antenna element is disposed in a groove concavely formed on the surface of the substrate.

8. The antenna as claimed in claim 1, further comprising:

at least one reflecting plate configured to:

reflect electromagnetic waves transmitted by the second antenna element in a third direction, and reflect electromagnetic waves received by the second antenna element in a fourth direction.

9. A wireless communication apparatus, the apparatus comprising:

an antenna comprising:

a substrate having a surface and a via hole formed on the surface, wherein the via hole starts at the surface and ends within the substrate, a first antenna element formed on the surface of the substrate and configured to have a first radiation pattern in a first direction, a second antenna element formed in the via hole of the substrate and configured to have a second radiation pattern in a second direction, a current feeder, electrically connected to the first antenna element, configured to supply power to the first antenna element, and an adjuster comprising a switch configured to:

electrically connect the first antenna element to the second antenna element to supply the power to the second antenna element through the first antenna element in a first configuration so that the second antenna element emits corresponding electromagnetic waves in the second radiation pattern in the second direction, and electrically disconnect the first antenna element from the second antenna element in a second configuration so that the first antenna element emits corresponding electromagnetic waves in the first radiation pattern in the first direction, wherein the first direction and the second direction are perpendicular to each other; and at least one processor configured to control an operation of the antenna in order to perform wireless communication.

10. The apparatus as claimed in claim 9, wherein the first antenna element and the second antenna element are electrically connected to form one antenna element when the switch electrically connects the first antenna element to the second antenna element.

11. The apparatus as claimed in claim 9, wherein the adjuster comprises a phase adjuster configured to:

adjust a phase of electromagnetic waves transmitted by at least one of the first antenna element and the second antenna element, and adjust a phase of electromagnetic waves received by at least one of the first antenna element and the second antenna element.

12. The apparatus as claimed in claim 9, wherein at least one of the first antenna element and the second antenna element comprises a plurality of antennas, and wherein at least one of the plurality of antennas is positioned at a corner portion of the wireless communication apparatus.

13. The apparatus as claimed in claim 9, wherein at least one of the first antenna element and the second antenna element comprises a plurality of antennas, and wherein at least one of the plurality of antennas is positioned at an edge portion of the wireless communication apparatus.

14. A wireless communication method, the method comprising:

supplying power to a first antenna element of an antenna, the first antenna element formed on a surface of a substrate of the antenna and configured to have a first radiation pattern in a first direction;

controlling a switch configured to:

electrically connect the first antenna element to a second antenna element formed in a via hole formed on the substrate and configured to have a second radiation pattern in a second direction to supply the power to the second antenna element through the first antenna element in a first configuration so that the second antenna element emits corresponding electromagnetic waves in the second radiation pattern in the second direction, and electrically disconnect the first antenna element from the second antenna element in a second configuration so that the first antenna element emits corresponding electromagnetic waves in the first radiation pattern in the first direction; and transmitting first electromagnetic waves through the first antenna element and the second antenna element and receiving second electromagnetic waves through the first antenna element and the second antenna element, wherein the via hole starts at the surface of the substrate and ends within the substrate, and wherein the first direction and the second direction are perpendicular to each other.

15. The method as claimed in claim 14, wherein at least one of the first antenna element and the second antenna element comprises a plurality of independents antenna elements.

16. The method as claimed in claim 14, wherein the transmitting and receiving of the first and second electromagnetic waves, respectively, comprises:

electrically connecting the first antenna element to a current feeder;

electrically connect the first antenna element and the second antenna element; and transmitting and receiving the first and second electromagnetic waves, respectively, through the first and the second antenna element connected to the current feeder.

17. The method as claimed in claim 14, wherein the transmitting and receiving of the first and second electromagnetic waves, respectively, comprises:

adjusting a phase of electromagnetic waves transmitted by at least one of the first antenna element and the second antenna element; and adjusting a phase of electromagnetic waves received by the at least one of the first antenna element and the second antenna element.

18. The method as claimed in claim 17, further comprising:

determining a strength of the electromagnetic waves transmitted by the at least one of the first antenna element and the second antenna element, and determining a strength of the electromagnetic waves received by the at least one of the first antenna element and the second antenna element wherein a phase of the electromagnetic waves transmitted and the electromagnetic waves received is adjusted according to the corresponding determined strength.

19. The method as claimed in claim 14, wherein the first antenna element is disposed in a groove concavely formed on the surface of the substrate.

20. The method as claimed in claim 14, further comprising:

reflecting electromagnetic waves transmitted by the second antenna element in a third direction, and reflecting electromagnetic waves received by the second antenna element in a fourth direction.

* * * * *